US009272179B2

(12) United States Patent
Lemos et al.

(10) Patent No.: US 9,272,179 B2
(45) Date of Patent: Mar. 1, 2016

(54) TENSION SYSTEMS AND METHODS OF USE

(71) Applicant: Personal Trainer, Inc., Modesto, CA (US)

(72) Inventors: Robert F. Lemos, Escalon, CA (US); Kenfield Alldrin, Modesto, CA (US)

(73) Assignee: THE PERSONAL TRAINER, INC., Modesto, CA (US)

( * ) Notice: Subject to any disclaimer, the term of this patent is extended or adjusted under 35 U.S.C. 154(b) by 252 days.

(21) Appl. No.: 13/837,838

(22) Filed: Mar. 15, 2013

(65) Prior Publication Data

US 2013/0203558 A1 Aug. 8, 2013

Related U.S. Application Data

(63) Continuation-in-part of application No. 12/606,123, filed on Oct. 26, 2009, now Pat. No. 8,992,385.

(51) Int. Cl.
*A63B 21/005* (2006.01)
*A63B 21/08* (2006.01)
(Continued)

(52) U.S. Cl.
CPC ..... *A63B 21/06* (2013.01); *A63B 21/00076* (2013.01); *A63B 21/0628* (2015.10); *A63B 21/0632* (2015.10); *A63B 21/078* (2013.01); *A63B 21/0783* (2015.10); *A63B 21/151* (2013.01); *A63B 21/154* (2013.01); *A63B 21/159* (2013.01); *A63B 21/4035* (2015.10); *A63B 21/4043* (2015.10); *A63B 23/03525* (2013.01); *A63B 23/12* (2013.01); *A63B 24/0062* (2013.01); *A63B 71/0054* (2013.01); *A63B 21/002* (2013.01); *A63B 21/4029* (2015.10); *A63B 23/0494* (2013.01); *A63B 23/085* (2013.01); *A63B 23/1236* (2013.01); *A63B 2023/0411* (2013.01);
(Continued)

(58) Field of Classification Search
USPC ..... 482/1, 5, 92–94, 97, 99, 114, 115, 116, 482/118, 120, 130, 133, 135, 148
See application file for complete search history.

(56) References Cited

U.S. PATENT DOCUMENTS 3,573,865 A * 4/1971 Annas ..... A63B 21/0615 482/101
4,422,636 A 12/1983 de Angeli
(Continued)

OTHER PUBLICATIONS

ISR from PCT/US2011/023883 dated Mar. 31, 2011.
(Continued)

*Primary Examiner* — Loan H Thanh
*Assistant Examiner* — Shila Jalalzadeh Abyane
(74) *Attorney, Agent, or Firm* — Mark D. Miller; William K. Nelson

(57) ABSTRACT

Machines, apparatuses, systems and methods for providing adjustable tension to a cable system using a pivotally mounted leverage mechanism that employs an adjustably positionable weight. Embodiments are used in exercise and other muscle strengthening devices, and may include an electronic control system for monitoring, recording a user's progress, and for altering or releasing tension to the cable system based on feedback from the user. Embodiments include a user interface for inputting information for particular exercises or workouts, as well as outputting/downloading information following exercises or workouts. Other embodiments allow adjustment to the starting point of the lifting bar so that such machines may be used for bench presses, squats, cleans or curls.

57 Claims, 16 Drawing Sheets

(51) Int. Cl.

| | |
|---|---|
| ***A63B 21/062*** | (2006.01) |
| ***A63B 21/06*** | (2006.01) |
| ***A63B 21/078*** | (2006.01) |
| ***A63B 21/00*** | (2006.01) |
| ***A63B 23/12*** | (2006.01) |
| ***A63B 71/00*** | (2006.01) |
| ***A63B 24/00*** | (2006.01) |
| ***A63B 23/035*** | (2006.01) |
| *A63B 23/04* | (2006.01) |
| *A63B 23/08* | (2006.01) |
| *A63B 21/002* | (2006.01) |

(52) U.S. Cl.
CPC *A63B 2024/0068* (2013.01); *A63B 2071/0072* (2013.01); *A63B 2225/20* (2013.01)

(56) References Cited

U.S. PATENT DOCUMENTS

| | | | | | |
|---|---|---|---|---|---|
| 4,471,956 | A | | 9/1984 | Marlo | |
| 4,620,703 | A | | 11/1986 | Greenhut | |
| 4,650,185 | A | * | 3/1987 | Cartwright | A63B 21/0615 482/5 |
| 4,657,246 | A | * | 4/1987 | Salyer | A63B 21/062 482/94 |
| 4,763,897 | A | | 8/1988 | Yakata | |
| 4,807,875 | A | * | 2/1989 | Tanski | A63B 21/00181 200/332 |
| 4,822,036 | A | | 4/1989 | Dang | |
| 4,834,365 | A | | 5/1989 | Jones | |
| 4,836,536 | A | | 6/1989 | Jones | |
| 4,863,161 | A | * | 9/1989 | Telle | A63B 21/00072 482/112 |
| 4,875,676 | A | | 10/1989 | Zimmer | |
| 4,902,009 | A | | 2/1990 | Jones | |
| 4,989,859 | A | | 2/1991 | Jones | |
| 5,048,826 | A | | 9/1991 | Ryan | |
| 5,102,121 | A | | 4/1992 | Solow et al. | |
| 5,310,394 | A | | 5/1994 | Kallios | |
| 5,314,394 | A | | 5/1994 | Ronan | |
| 5,344,374 | A | * | 9/1994 | Telle | A63B 21/00072 482/112 |
| 5,407,403 | A | | 4/1995 | Coleman | |
| 5,722,921 | A | | 3/1998 | Simonson | |
| 5,785,632 | A | | 7/1998 | Greenberg et al. | |
| 5,993,356 | A | | 11/1999 | Houston et al. | |
| 6,293,892 | B1 | | 9/2001 | Slawinski et al. | |
| 6,379,287 | B1 | | 4/2002 | Slawinski et al. | |
| 6,537,182 | B2 | | 3/2003 | Slawinski et al. | |
| 6,558,299 | B1 | | 5/2003 | Slattery | |
| 6,669,607 | B2 | | 12/2003 | Slawinski et al. | |
| 6,749,538 | B2 | | 6/2004 | Slawinski et al. | |
| 6,893,381 | B2 | | 5/2005 | Slawinski | |
| 6,926,649 | B2 | | 8/2005 | Slawinski | |
| 7,029,426 | B1 | | 4/2006 | Fuller, Sr. | |
| 7,163,488 | B2 | | 1/2007 | Anders et al. | |
| 7,278,958 | B2 | | 10/2007 | Morgan | |
| 7,374,515 | B2 | | 5/2008 | Slawinski et al. | |
| 7,387,595 | B2 | * | 6/2008 | Towley, III | A63B 21/0605 482/100 |
| 7,527,568 | B2 | | 5/2009 | Joseph | |
| 7,575,537 | B2 | | 8/2009 | Ellis | |
| 7,591,771 | B2 | | 9/2009 | Rullestad | |
| 7,976,441 | B2 | * | 7/2011 | Ellis | A63B 21/0615 482/114 |
| 8,216,116 | B2 | * | 7/2012 | Canali | A61H 1/0281 482/121 |
| 2004/0254050 | A1 | * | 12/2004 | Morgan | A63B 21/00072 482/122 |
| 2005/0233871 | A1 | | 10/2005 | Anders et al. | |
| 2007/0179030 | A1 | | 8/2007 | Slawinski | |
| 2010/0216600 | A1 | | 8/2010 | Noffsinger | |
| 2013/0184128 | A1 | * | 7/2013 | Towley, III | A63B 21/0628 482/102 |

OTHER PUBLICATIONS

REP-MAXX, Advertisement for the RM 250 Bench Press machine, Jan. 2012.
REP-MAXX, Advertisement for the RM 250 Bench Press and RM Squat machines, May 2012.
REP-MAXX, Advertisement for the RM 250 Bench Press machine, National Fitness Trade Journal, Jan. 2012.
REP-MAXX, Advertisement for the RM 250 Bench Press machine, National Fitness Trade Journal, Mar. 2012.
REP-MAXX, Advertisement for the RM 250 and 450 Bench Press machines and RM Squat machine, National Fitness Trade Journal, May 2012.
REP-MAXX, Advertisement for the RM 250 Bench Press machine, Oct. 2011.
REP-MAXX, Advertisement for the RM 250 Bench Press machine, CBI Magazine, Feb. 2012.
Bruce Pechman, Fitness Equipment Review: Rep-Maxx "RM 250" Computer Controlled Intelligent Bench Press Machine, Jul. 2011, available online at www.mrbicep.com.
ISR from PCT/US2014/029178 dated Sep. 28, 2014.

* cited by examiner

FRONT VIEW

TOP VIEW

SIDE VIEW

TENSION SYSTEMS AND METHODS OF USE

RELATED APPLICATIONS

This application is a continuation-in-part of U.S. patent application Ser. No. 12/606,123, filed Oct. 26, 2009, which is incorporated herein by this reference in its entirety.

FIELD OF THE INVENTION

The present invention relates to cable tensioning systems, and more particularly to unique and compact adjustable cable tensioning systems, apparatus, machines and related methods for use in such applications as weight training, exercising, muscle toning, muscle development, and the like.

DISCUSSION OF THE BACKGROUND

Weight training is a common form of exercise to increase strength and build muscle. A typical weight lifting apparatus includes a bar that is capable of receiving weights on both ends. The user places the desired weights on the bar, and then lifts the bar so that the weights act as resistance to the muscles of the user. A certain number of repetitions of the lift are performed in order to complete a particular exercise. Typically, the most beneficial parts of the exercise are the last few repetitions where the user may become fatigued, but where maximum muscle strength is developed. Because of the fatigue factor, the user may become exhausted and unable to complete the exercise with the selected weights. This results in at least two problems. First, in order to complete the set of repetitions, if fatigue sets in, the user may be required to stop the exercise, change the weight resistance (which may include both removing and replacing weights), and then resume. This may interrupt critical timing in the exercise. Second, the fatigue experienced by the user is dangerous in that the weights may be dropped or mishandled, resulting in injury to the user. A second person or spotter is typically used to assist the weight lifter to catch the weight in case fatigue causes a problem. However, a second person is not always available which may expose the weight lifter to unnecessary risk of injury.

In order to avoid having to add and remove physical weights to change the resistance, numerous weightlifting systems have been developed as alternatives to bar and weight systems that employ cable and pulley systems to transfer weight loads, such as those described in U.S. Pat. No. 5,407,403 and U.S. Patent Application Publication No. 2005/0233871. In order to avoid the need for a second person to act as a spotter, cable and pulley systems have also been developed for use as spotter systems, such as those described in U.S. Pat. Nos. 5,048,826, 5,310,394, 5,314,394, and 6,558,299. Unfortunately, none of these inventions provides a simple, compact weight resistance system that has the combined capabilities of (a) providing variable adjustability in the amount of tension (weight) placed on the cable, including automatic tension adjustment (reduction or release) near the end of a set of repetitions when the user is becoming fatigued; and (b) providing an automatic spotting/safety function without the need for a second person.

Electronic monitoring and feedback systems for weightlifting have also been developed, as described in U.S. Pat. Nos. 5,785,632 and 5,993,356.

It is therefore desirable to provide the combined capabilities of variable and automatic tension adjustability, including reduction and potential release (spotting) in a compact tension resistance system that may be adapted for use in numerous different weight lifting methods and apparatus. It is further desirable that such systems provide real time feedback to the user during exercise, and record the results of the user's exercise for future use.

SUMMARY OF THE INVENTION

Embodiments of the present invention provide apparatuses, machines, systems and methods for providing adjustable tension to cable, rope, wire, cord, chain, belt, strap or other similar devices (sometimes referred to herein for convenience using the general term "cable") using a pivotally mounted leverage mechanism that is associated with one or more adjustably positionable weights. In embodiments of the invention, one or more cables are attached to the leverage mechanism which provides tension to the cable(s). Tension to the cable(s) may be increased or decreased by changing the position of the weight(s) associated with the leverage mechanism. Embodiments of the invention may be used in exercise and other muscle strengthening devices, and may include an electronic control system for monitoring and recording a user's progress, and altering or releasing tension to the cable system based on feedback from the user. Embodiments of the invention may also include a user interface for inputting information for particular exercises or workouts, as well as outputting/downloading information following exercises or workouts.

In some embodiments, the leverage mechanism includes an elongated threaded screw member that is rotated using a drive motor attached at one end of the screw member. A carriage may be provided in these embodiments that is movably engaged with the screw member so that rotation of the screw member by the drive motor causes the carriage to move along the length of the screw member. In these embodiments, rotation of the screw member in one direction will cause the carriage to move in one direction along the lever member, and rotation in the opposite direction will cause the carriage to move in the opposite direction along the lever member. In some embodiments, the screw member itself may be pivotally (and rotatably) mounted in order to act as a lever.

In some embodiments, the leverage mechanism includes a belt or chain member that is attached to a weight carriage and moves the weight carriage along the lever member. The weight carriage may be movably engaged with the lever member on a track. For example and without limitation, the belt or chain member may be attached to a motor that pulls the belt or chain around an axle, thereby pulling the weight carriage along the lever member. In these embodiments, rotation of the axle in one direction will cause the carriage to move in one direction along the lever member, and rotation of the axle in the opposite direction will cause the carriage to move in the opposite direction along the lever member.

A cable is attached directly or indirectly at or near one end of the lever mechanism or screw member. Tension on the cable is increased or decreased depending on the position of the weight (which may be on a carriage) on the lever member.

In alternative embodiments, the carriage may be movably provided on one or more elongated rails, tracks or other supports. In these embodiments, the rail, track or support is pivotally mounted in order to act as a lever, and a cable is attached directly or indirectly near one end of the rail, track or support. It is to be appreciated that the movable weight or the carriage supporting the weight may be directly or indirectly attached to any suitable motion imparting device, such as a pneumatic or hydraulic piston assembly, a rod and motor assembly, a threaded screw member as described above, a chain and sprocket system, a motor and belt system, or the like. Movement of the piston, motor, chain, belt etc. causes the weight or carriage to move along the rail, track or other support lever. Tension on the cable is increased or decreased depending on the position of the weight or the carriage on the lever.

It is to be appreciated that the carriage may be provided in any suitable form so long as it is movable along the lever mechanism according to the movement of the motion imparting device. In some of these embodiments, additional weight is provided on or attached to the carriage.

In the preferred embodiments, one end of a cable is attached directly or indirectly near an end of the leverage mechanism, and the other end of the cable is attached to and threaded around a rotatably mounted disc, pulley or sprocket for communication of tension to such disc, pulley or sprocket. In these embodiments, the central axis of such disc, pulley or sprocket is attached to a rod. A separate cam is also attached to this rod such that the disc and cam share a common axis in the rod. One end of a second cable is attached to and wrapped around the outside edge of the cam, and the opposite end of the second cable is attached directly or indirectly to a weight lifting bar or the like for communication of tension to such bar. It is to be appreciated that the outside edges of the disc and cam may have a U-shaped cross section in embodiments using a cord-like structure for the two cables in order to receive and guide the cables. Other embodiments may use sprockets and chains or belts, which may be connected, on one end to cables leading to the lever mechanism and on the other end to the lifting bar.

In some embodiments, tension is imparted to the disc by the first cable, then transmitted to the cam through the rod, and then transmitted directly or indirectly to the lifting bar through the second cable. The amount of tension may be varied depending on the position of the carriage, and/or the associated weight thereon, relative to the point at which the first cable is attached to the leverage mechanism. The tension may also affected by the location of the pivot. As the lifting bar is moved, it pulls on the second cable thereby causing the cam to rotate. This rotation is resisted by the tension imparted to the cam from the leverage mechanism through the first cable, and rod and/or disc. When the tension provided by the second cable is greater than the tension provided by the first cable, both the cam and disc rotate, causing the leverage mechanism to move through an arc about its pivotal mount. The outside edge of the cam is preferably shaped so as to provide even tension to the second cable to compensate for variations as the leverage mechanism moves through this arc. This shape of the cam helps maintain consistent cable tension throughout the upward and downward strokes of the lifting bar.

In some embodiments, the weight system may include a cable carriage mounted on the lever member that may serve as a connection point between a weight bearing cable and the lever member. The cable carriage may be positioned on a side of the lever member (e.g., on the top or bottom of the lever member), and may be engaged with a single weight bearing cable that is attached at each end to a weight lifting bar. The cable carriage may be moveably engaged with the lever member, such that the cable carriage may be moved along the lever member to various positions. For example, and without limiting the invention, the cable carriage may include wheels that are engaged with a track in the lever member. The cable carriage may include an elongated threaded screw member that is rotated using a drive motor attached at one end of the screw member. The cable carriage may be movably engaged with the screw member so that rotation of the screw member by the drive motor causes the carriage to move along the length of the screw member and the lever member. In such embodiments, rotation of the screw member in one direction will cause the cable carriage to move in one direction along the lever member, and rotation in the opposite direction will cause the cable carriage to move in the opposite direction along the lever member.

In such embodiments, the cable carriage may act as mechanism for adjusting slack in the weight-bearing cable to allow the weight lifting bar to be positioned at various heights and/or distances from the weight system. For example, and without limiting the invention, as the cable carriage moves toward a pivot of the lever member, slack in the weight-bearing cable may be taken up by the carriage, thereby reducing a height at which the weight lifting bar can be positioned. The cable carriage may also function as a safety feature. For example, and without limiting the invention, an elongated threaded screw member may be engaged with the cable carriage (as described above) that positions the cable carriage by rotating in either direction. In the event of an emergency, the screw member may be allowed to rotate freely, thereby allowing the cable carriage to move toward an end of the lever member and creating slack in the weight-bearing cable. The increased slack in the weight-bearing cable removes the tension created by the lever member and weight thereon. For example and without limitation, the screw member may be engaged with and driven by an electric motor. When there is a power failure or an emergency switch is engaged, the electric motor may disengage the screw member, thereby allowing the cable carriage to move to the end of the lever member and release the tension in the weight-bearing cable.

It is to be appreciated that the amount of tension imparted increases as the carriage and/or weight are moved closer to the end of the leverage mechanism where the first cable is attached (for example, at a point that is away from the pivot); similarly, the amount of tension is decreased as the carriage and/or weight are moved away from the end of the leverage mechanism where the first cable is attached (for example, at a point that is toward the pivot). It is to be appreciated that the leverage mechanisms of the present invention may be provided in different lengths, and that the weight(s) associated with the carriage may be provided in different amounts depending on the space availability and the tension requirements of the user. For example, and without limitation, a relatively short leverage mechanism may be provided with a heavy weight such that slight movement of the weight and/or carriage results in a significant change in tension; but, if a longer leverage mechanism is provided with the same weight the same amount of movement by the weight and/or carriage would provide a lesser change in tension. In some examples, a longer leverage mechanism could allow for a greater maximum tension than a shorter one.

In the preferred embodiments, the position of the weight and/or carriage is calibrated in order to allow calculation of the amount of tension provided by the leverage mechanism. An electronic interface and processing system may be provided in these embodiments so that a user may electronically select and/or adjust the tension ("weight") placed on the cables by changing the position of the weight on the lever mechanism. This replaces the need to add or remove actual physical weights as in a traditional weight-lifting setup. The electronic system may monitor the user's resistance to tension on the cable during use in order to detect potential fatigue in the user. In these embodiments, if the user's resistance drops, the electronic system may automatically adjust (lessen) the tension on the cable by causing the weight and/or carriage to move, in order to reduce the tension on the cable and allow the user to stop, alter or continue exercise at a different level. The electronic interface may also provide signals to the user during use, such as digital readouts, alarms, audible commands or the like. In some embodiments, the electronic system may also record data from a user's exercise workouts for compilation and later review by the user to measure muscle strength gain, for evaluation, for comparison to previous workouts, for developing future workouts, etc. In some embodiments, data recorded through the electronic system may be transmitted or downloaded to another computerized device, including portable and/or hand-held computing devices, either simultaneously with the performance of a workout, or afterwards.

In embodiments of the invention, the electronic system detects when the lifting speed of the cables decreases or stalls, and automatically/incrementally reduces the tension on the cables so that the speed stays the same. This has the effect of being an "automatic spotter" allowing the lifter to complete a lift with lesser weight. In emergency situations (e.g., a prolonged stall, or a sudden loss in resistance by the user—which may be measured in fractions of a second) the tension on the cables may be completely released or interrupted in order to avoid injury to the user. In some embodiments, a separate spotter cable may be provided with a latch or other movement arresting mechanism that may be engaged to prevent the lifting bar from falling on the user.

Several embodiments of the present invention may be implemented in various exercise machines. For example, and without limitation, embodiments of the invention may be implemented in weight lifting systems, bench press systems, squat systems, knee lift systems, hand or arm pull systems, leg presses, calf raisers, and others. Embodiments of the present invention may be used at gymnasiums, in the medical field for strengthening, development and/or rehabilitation of infirm or injured persons, and in weight or strength training camps.

It is therefore an object of the present invention to provide variable and automatic cable tension adjustability, including tension reduction and potential tension release, in a compact tension resistance system that may be adapted for use in numerous different exercise or strengthening methods and apparatus.

It is also an object of the present invention to provide cable-based systems, apparatus, machines and methods for exercise and improving muscle strength in which the tension (weight) on the cable(s) may be adjusted by a user without manually attaching or removing physical weights.

It is also an object of the present invention to provide cable-based systems, apparatus, machines and methods for exercise and improving muscle strength in which the user's activity is monitored, and the tension (weight) on the cable(s) is automatically adjusted according to the monitored activity.

It is also an object of the present invention to provide cable-based exercise or strength improvement systems and methods for providing real time feedback to a user during exercise, and real time cable tension adjustment during exercise.

It is also an object of the present invention to provide cable-based exercise or strength improvement systems and methods capable of acting as an automatic spotter to monitor and automatically reduce or eliminate tension (weight) on the cable system if user fatigue is detected.

It is also an object of the present invention to provide cable-based exercise or strength improvement systems and methods capable of recording and storing the results of a user's exercise, and making those results available for download onto a hand held or other electronic device.

Additional objects of the invention will be apparent from the detailed description and the claims herein.

DETAILED DESCRIPTION OF THE EXEMPLARY EMBODIMENTS

Figure 1:
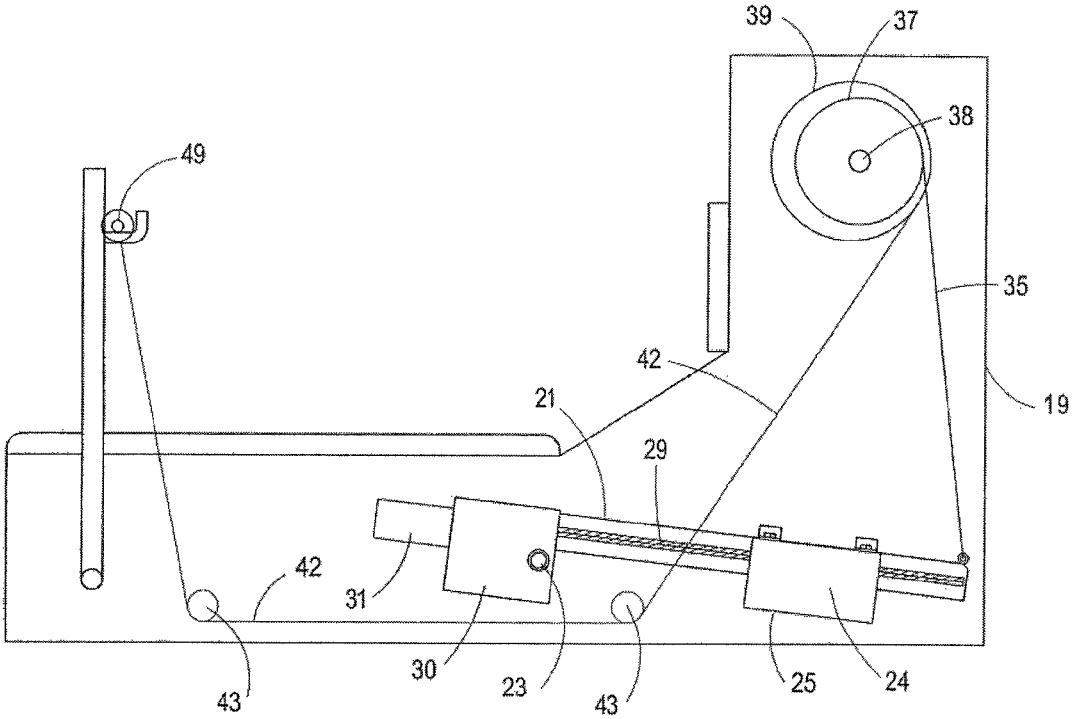
FIG. 1 is a side sectional view of an embodiment of the invention showing a lifting bar near the middle of a stroke, resting on supports.
Figure 2:
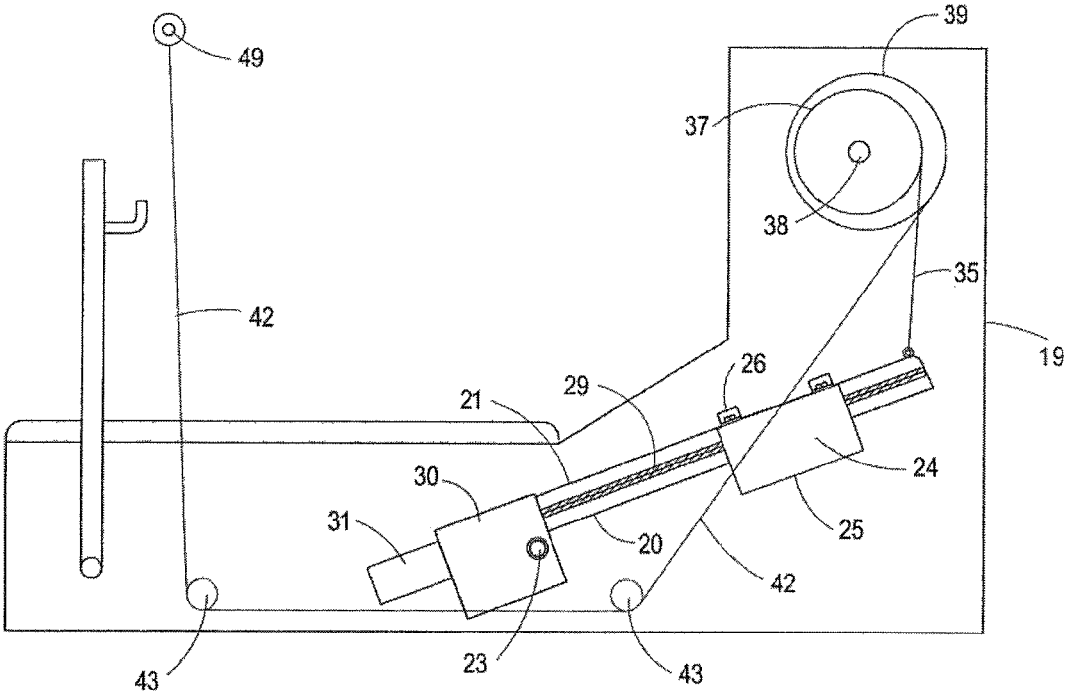
FIG. 2 is a sectional side sectional view of an embodiment of the invention showing a lifting bar near the top of a stroke.

Referring to the drawings wherein like reference characters designate like or corresponding parts throughout the several views, and referring particularly to the exemplary embodiments of FIGS. 3-9, it is seen that these embodiments include a leverage system for installation inside a cabinet or frame 19 comprising an elongated member 20 having a track 21 (see FIG. 9) for supporting a movable carriage 25 using wheels, guides or other supports 26. At least one weight 24 is provided with, on or made a part of carriage 25. Member 20 is pivotally mounted at 23 so that it may operate as a lever. It is to be appreciated that in other embodiments (such as the embodiment illustrated in FIG. 15), that weight 24 may be movably provided directly on lever member 20.

Figure 1A:
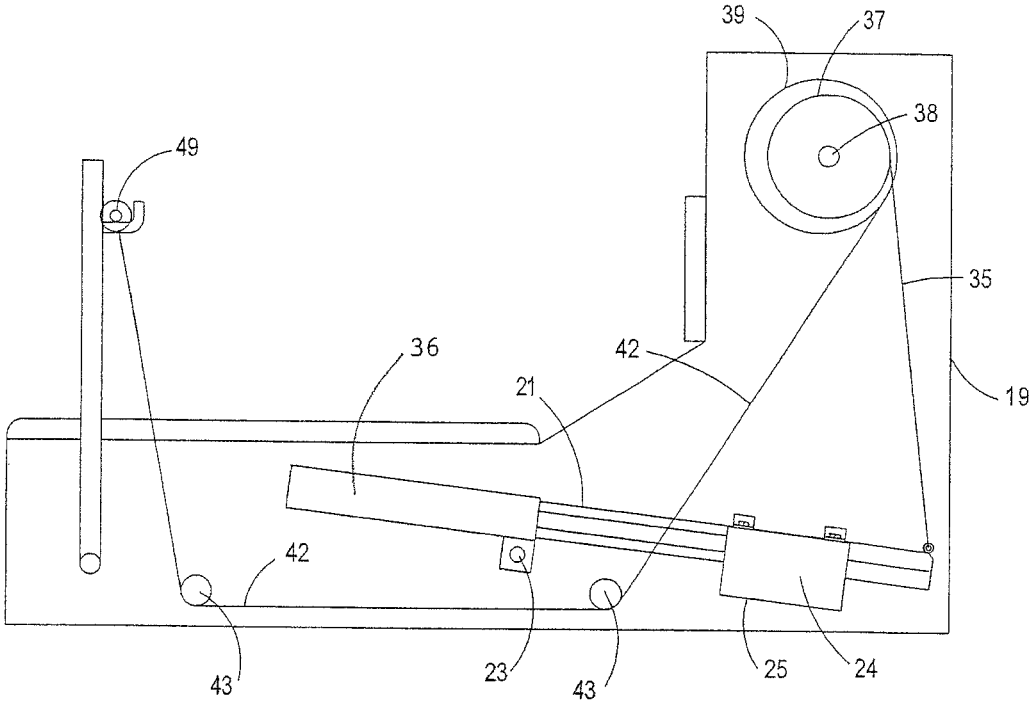
FIG. 1A is a sectional side view of an alternative embodiment of the invention showing a piston assembly.

In the embodiments illustrated in FIGS. 3-9, a threaded screw 29 is provided in parallel with lever member 20. A drive motor 30 is provided, preferably at one end of screw 29, to impart rotation to it. A threaded bore (see FIG. 9) is provided in carriage 25 for receiving screw 29, so that as screw 29 is turned by motor 30, carriage 25 moves along the length of screw 29. It is to be appreciated that turning screw 29 in one direction will cause carriage 25 to move towards, motor 30, and turning screw 29 in the opposite direction will cause carriage 25 to move away from motor 30. It is to be appreciated that in other embodiments, weight 24 may be movably provided directly on lever member 20 and that screw 29 may be threaded through a bore in weight 24 itself. However, it is to be appreciated that other means of moving weight 24 on lever member 20 are contemplated in accordance with some embodiments of the present invention. For example, and without limitation, motor 30 and screw 29 can be replaced with a piston engaged with the carriage 25 as shown in FIG. 1A.

One end of a first cable 35 is attached near one end of lever member 20, at a distance from pivot 23. The opposite end of cable 35 is wrapped around an outside edge of a rotatable circular disc 37 and may be anchored thereto. Disc 37 is attached to a rod 38 that is rotatably mounted a distance from the end of lever member 20. A cam 39 is also attached to rod 38 and/or disc 37. It is to be appreciated that disc 37 may have a round circumference, but that cam 39 may not. Rotation of disc 37 causes cable 35 to impart a pulling force at the end of lever member 20 where cable 35 is attached, which causes this proximal end of lever member 20 to move in an arcuate direction about pivot 23. The closer that weight 24 (with or without carriage 25) is to this proximal end of lever member 20 and/or the point of attachment of first cable 35, the more pulling force is required through cable 35 to move lever member 20 in the arcuate direction 52.

Figure 3:
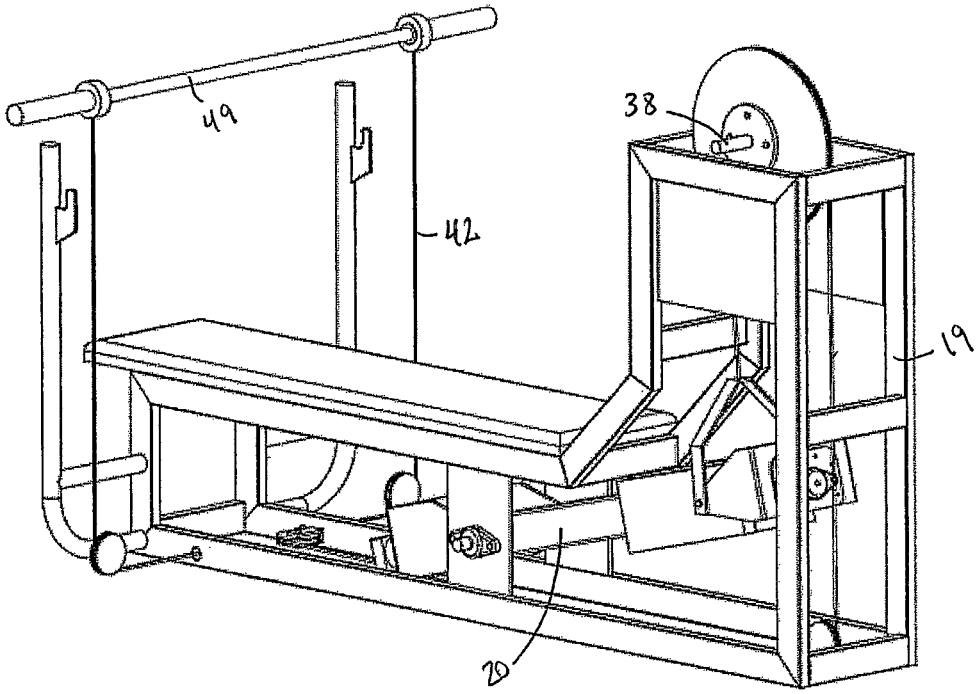
FIG. 3 is a perspective view of an embodiment of the invention showing a lifting bar near the top of a stroke.
Figure 4:
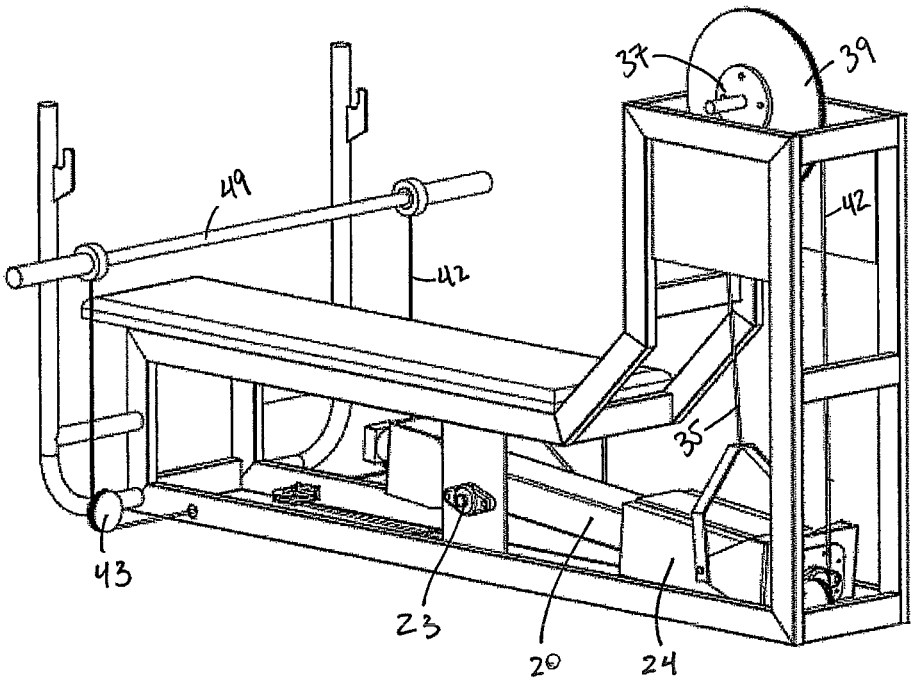
FIG. 4 is a perspective view of an embodiment of the invention showing a lifting bar near the bottom of a stroke.

One end of a second cable 42 is wrapped around an outside edge of cam 39 and may be anchored thereto. The opposite end of this cable is attached directly or indirectly to a lifting bar 49. Cable 42 is preferably split, or otherwise functionally divided, and threaded through one or more pulleys 43, terminating at opposite ends of lifting bar 49. In some embodiments, cable 42 may be attached to a separate pulley 45 that is engaged with a third cable 51, the ends of which are attached near the ends of bar 49 (See, e.g., FIG. 14). It is to be appreciated that as bar 49 is lifted as shown in FIGS. 3-4, a pulling force is transmitted through cable 42 to cam 39. This force is transmitted directly, or through rod 38, to disc 37, and then through cable 35 to the proximal end of lever member 20. Resistance to this force is provided by the weight 24, which may be provided on carriage 25. The amount of resistance may be changed by changing the position of weight 24 and/or carriage 25 on lever member 20. The movement of weight 24 on carriage 25 in the embodiments of FIGS. 2-9 is accomplished by the operation of motor 30, encoder 31 and screw 29. The outside edge of cam 39 may be shaped so as to keep the tension on cable 42 and lifting bar 49 consistent, in order to compensate for the upward/downward stroke of the bar 49 and the corresponding arcuate movement 52 of lever 20. It is to be appreciated that the shape of such a cam is related, among other things, to the length of the distance between pivot 23 and the proximal end of lever 20.

Detail of an exemplary cam and disc assembly are shown in FIGS. 10-13. In this embodiment, one end of cable 35 is attached to the proximal end of lever 20, and the opposite end is wrapped over an outside edge of disc 37, and attached thereto. The position of weight 24 on lever 20 determines the amount of tension provided through cable 35 to disc 37. Disc 37 is attached to central rod 38. Cam 39 is also attached to central rod 38. However, in some embodiments, disc 37 and cam 39 may be engaged together, for example, and without limitation, by rivets, screws, and/or bolts. In other embodiments, disc 37 and cam 39 can both be integrated on a unitary material, for example, and without limitation, by injection molding or casting. These alternative embodiments eliminate the need for rod 38. Referring back to the exemplary embodiments of FIGS. 10-31, it is seen that one end of another cable 42 is engaged over the outside edge of cam 39 and attached thereto, leading directly or indirectly to lifting rod 49. It is to be appreciated in order to rotate disc 37 rod 38 and/or cam 39, a opposing force equal to or greater than that from cable 35 is necessary. This opposing force is transmitted from lifting rod 49 through cable 42 to cam 39, and in the illustrated embodiment, through rod 38 to disc 35.

Figure 5:
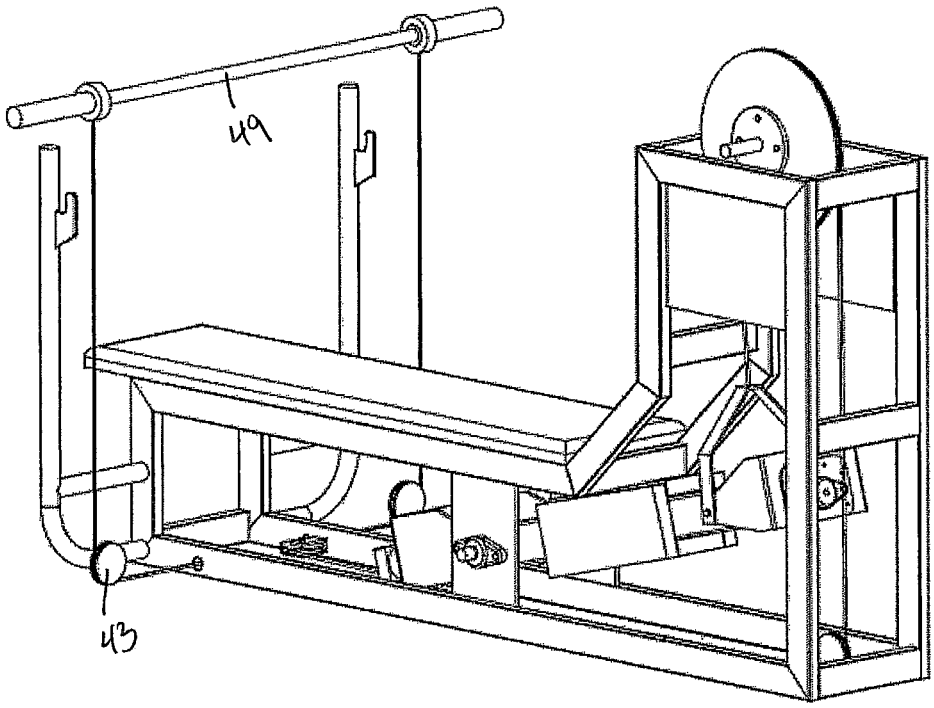
FIG. 5 is a perspective view of an embodiment of the invention showing a lifting bar near the top of a stroke.
Figure 6:
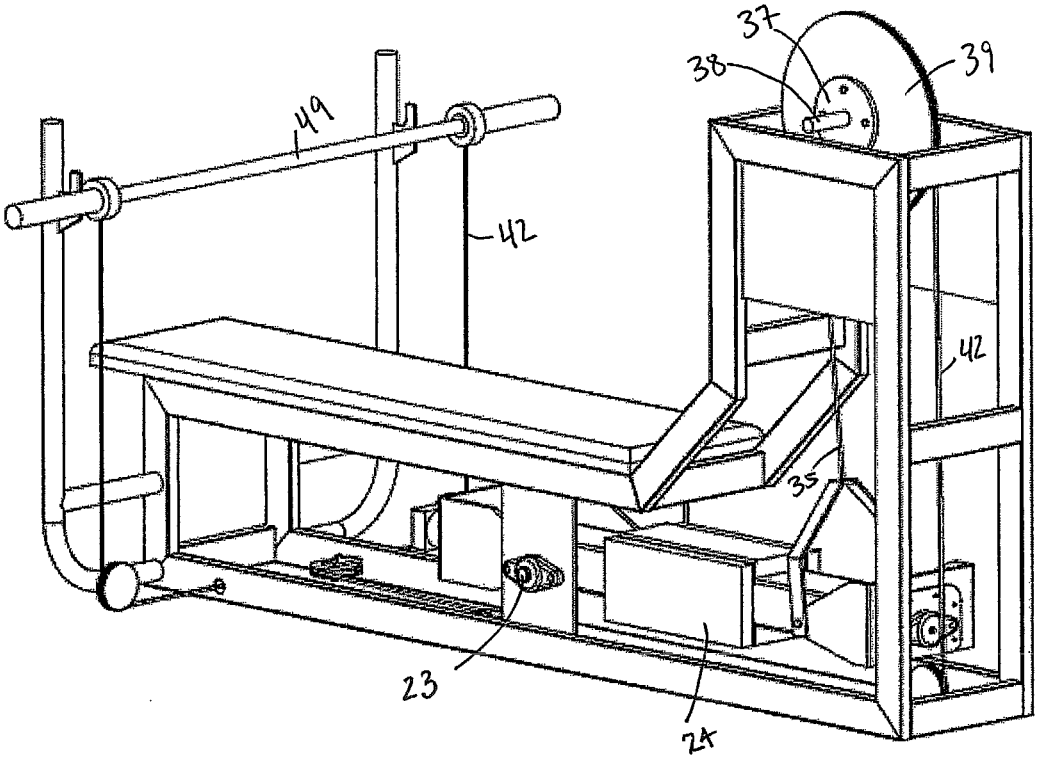
FIG. 6 is a perspective view of an embodiment of the invention showing a lifting bar near the middle of a stroke.
Figure 7:
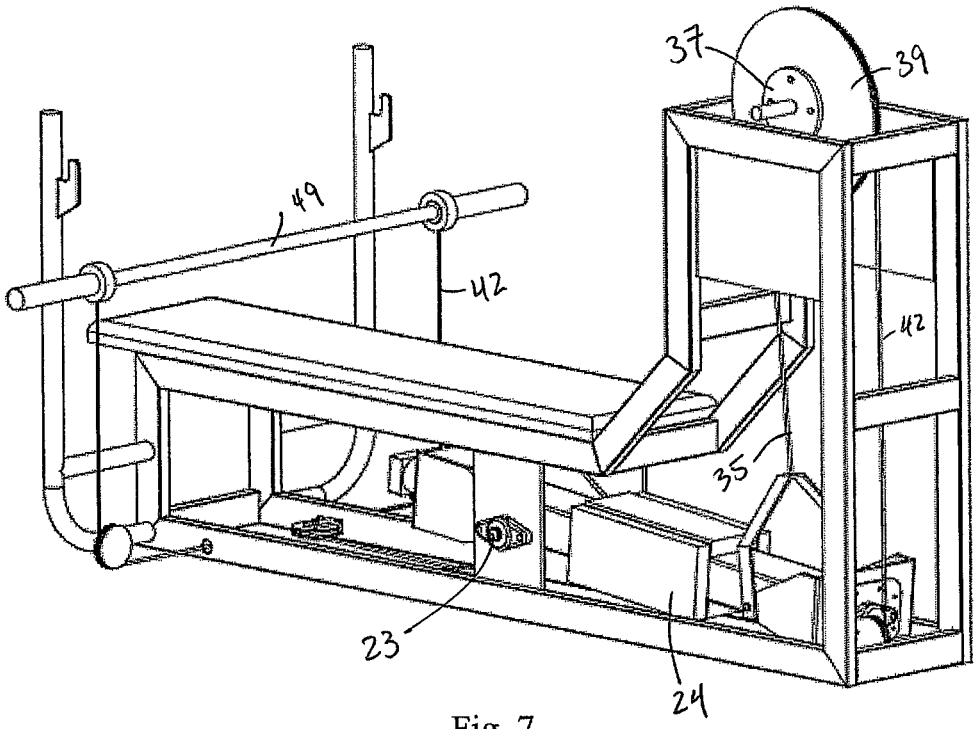
FIG. 7 is a perspective view of an embodiment of the invention showing a lifting bar near the bottom of a stroke.
Figure 8:
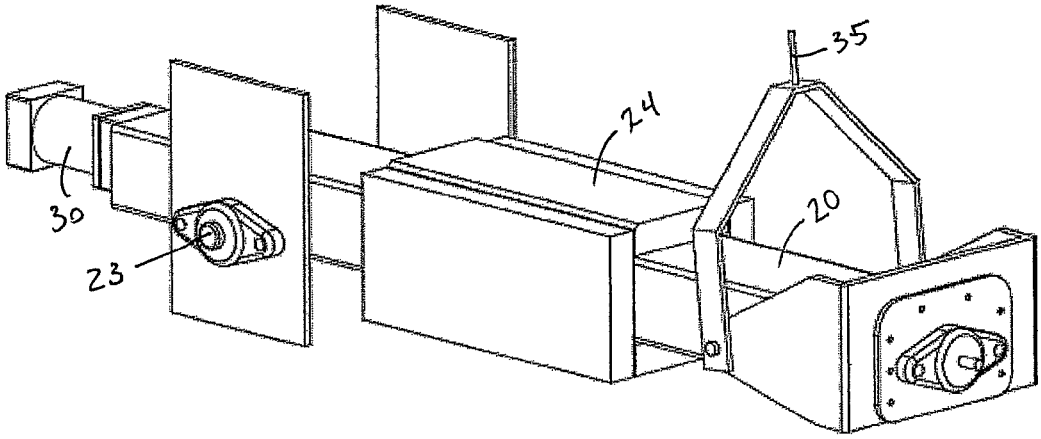
FIG. 8 is a perspective view of an embodiment of a leverage mechanism of the present invention.
Figure 9:
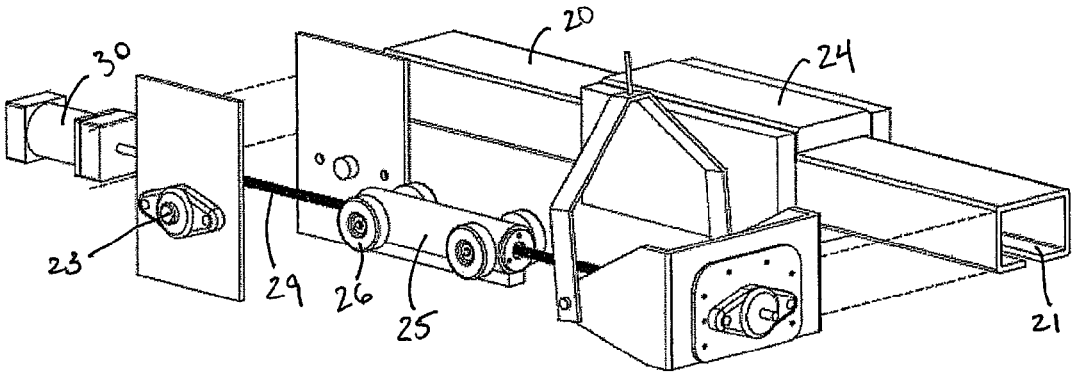
FIG. 9 is a partially exploded view of the leverage mechanism of FIG. 8.
Figure 10:
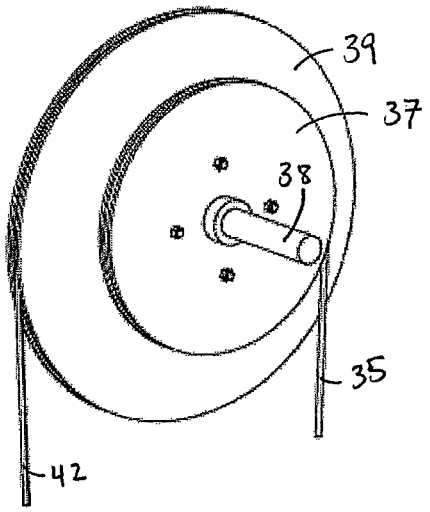
FIG. 10 is a perspective view of an embodiment of a cam and disc assembly of the present invention.
Figure 11:
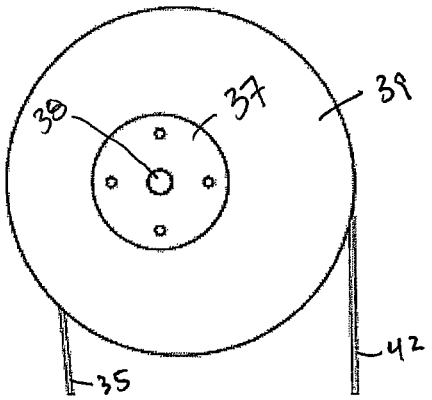
FIG. 11 is a front view of the assembly of FIG. 10.
Figure 12:
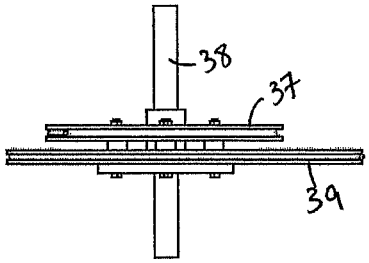
FIG. 12 is a top view of the assembly of FIG. 10.
Figure 13:
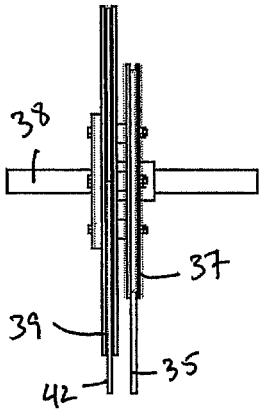
FIG. 13 is a side view of the assembly of FIG. 10.

In the exemplary embodiment shown in FIGS. 3 and 4, the position of carriage 25 and weight 24 has been moved toward the end of lever 20 for a maximum load (for example, and without limitation, 190 lbs.). FIG. 3 shows the position of an exemplary leverage system of the present invention near the top of a lifting stroke, and FIG. 4 shows the change in position near the bottom of a lifting stroke. In the exemplary embodiment shown in FIGS. 5-7, the position of carriage 25 and weight 24 has been moved toward the middle of lever 20 for a normal load (for example, and without limitation, 140 lbs.). FIG. 5 shows the position of an exemplary leverage system of the present invention near the top of a lifting stroke, FIG. 6 shows the change in position near the middle of a lifting stroke, and FIG. 7 shows the change in position near the bottom of a lifting stroke.

Figure 15:
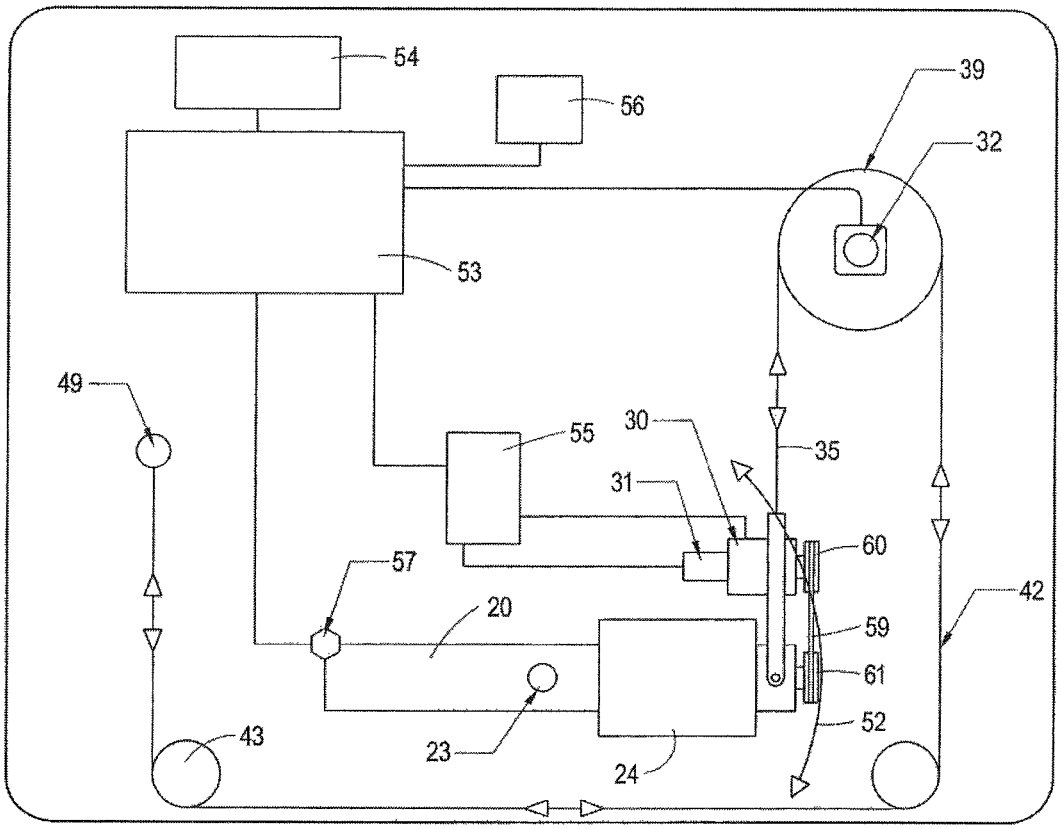
FIG. 15 is a schematic view of an alternative embodiment of the invention.

Referring to the illustrated exemplary embodiment of FIG. 15, it is seen that some embodiments of the invention may include an electronic system 53 having either manual inputs such as buttons, dials, switches, or the like (including without limitation one or more keypads), and/or electronic inputs and outputs such as a magnetic or optical reader, USB or other port, etc. provided on or with a user interface 54. A display is also provided in preferred embodiments of the user interface 54. The user may input his/her identity and other information regarding the desired workout using any of these inputs (keypad, manual ID number input, magnetic ID card, upload from a portable electronic device, etc.). Embodiments of the system 53 maintain information about each user and workouts performed by that user, from inputs on interface 53 or other data sources, discussed more fully below, for later review and/or download. A user's workout parameters may include such things as, without limitation, the weight(s) (tension) to be applied during a particular workout; number of repetitions for the workout; desired time interval(s) between repetitions and/or a time to complete the entire workout; any scheduled changes to be made to the tension during the workout (e.g. increasing, decreasing and/or alternating tension for different repetitions in the workout); ranges of acceptable deviations from any of tension, repetitions, time interval(s), etc.; and/or whether or not to record feedback from the workout. It is to be appreciated that different combinations of these selections may be made by the user to more particularly tailor a given workout or exercise regimen.

Some embodiments of the invention include a port or networking link 56 that allows data stored in the electronic system of the present invention to be accessed and/or downloaded, directly or indirectly, from or onto another device, such as a PDA, iPod, local storage, removable storage, network storage, network computer, or the like. This makes the data available for the user to incorporate into other databases, programs or devices for archival, study, entertainment, competition or other purposes. For example, and without limitation, a person going through rehabilitation following an accident or injury is able to keep track of exercises performed on machines of the present invention, and make comparisons to determine whether improvements are taking place over a period of time.

The programmable electronic system 53 is provided to control, among other things, motor 30 and the position of carriage 25 and/or weight 24 on lever mechanism 20 via screw 29. An encoder 31 is provided with motor 30, which is preferably a servo motor. Encoder 31 is calibrated in conjunction with motor 30, shaft 29, and weight 24 so that system 53 knows the precise position of weight 24 on lever 20 which can be used to determine the amount of weight (tension) provided on cable 35. The precision of the amount of weight provided depends on the type of encoder used, but in an exemplary embodiment, encoder 31 may count as many as 10,000 pulses for each rotation of shaft 29, although other less-precise encoders may be used and still provide satisfactory precision.

Referring to the exemplary alternative embodiment of FIG. 15, it is seen that a servo motor 30 and associated encoder 31 are provided in a roughly parallel orientation with lever 20. One end of motor 30 and a corresponding end of lever 20 are each provided with a rotatable wheel or sprocket around which a belt, chain, cable or other motion transmitter is provided to transfer rotational movement from the wheel or sprocket 60 on motor 30 to the wheel or sprocket 61 on lever 20. Wheel 61 is, in turn, associated with movable weight 24 such that rotation in one direction causes weight 24 to move in one direction along lever 20, and rotation in the opposite direction causes weight 24 to move in the opposite direction along lever 20.

Using the interface 54 and/or link 56, a user may select a desired amount of tension (for example, and without limitation, 140 lbs.), and in response, the system 53 operates motor 30 to move weight/carriage 24/25 to an appropriate location on lever 20 to provide the requested resistance to the cables leading to lifting bar 49. System 53 may or may not use an additional controller or other driver 55 to operate motor 30. The user interface 54 preferably includes controls that are easy to read and use, that are positioned close to the user, so that, if desired, adjustments in tension may be easily and quickly accomplished before, after or even during a set of repetitions.

Figure 14:
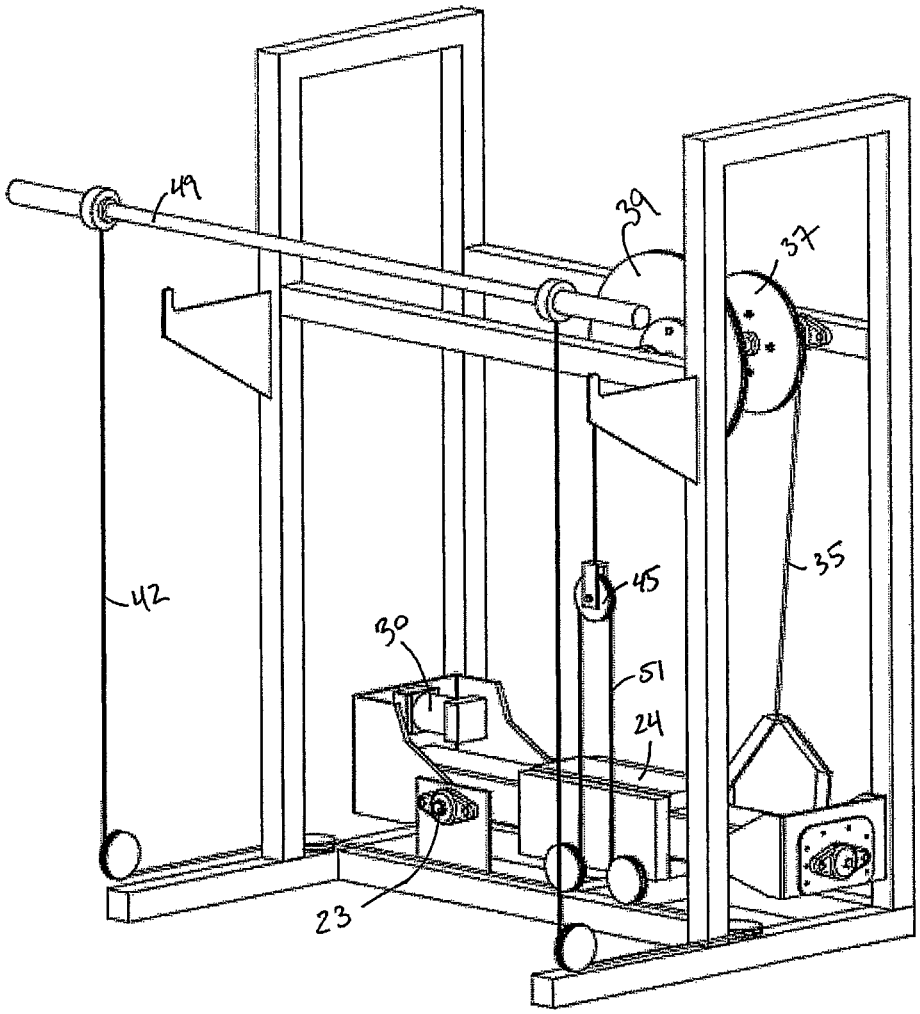
FIG. 14 is a perspective view of an alternative embodiment of the present invention.

Another encoder 32 is provided with rod 38, as shown in FIG. 14. During use, the programmable electronic system 53 monitors information received from encoder 32 which indicates the time and distance expended by the user during lifting repetitions. When this information is combined with the weight position information from encoder 31, system 53 can indicate the amount of force, energy, or other exercise parameters expended by the user. The system is preferably programmed to move the weight/carriage 24/25 in order to reduce the tension on the cables, if a decrease in the force provided by the user is detected through encoder 32. This reduction in tension is accomplished in real time, and may help the user to maintain consistency in the amount of time the user takes to complete a repetition by, for example, lowering tension level. For safety purposes, if a drastic reduction, loss, or unexpected reversal in force from the user is detected through encoder 32—indicating significant user fatigue—the programming in system 53 may cause motor 30 to rapidly move weight 24 away from the proximal end of lever 20, so as to release or reduce tension to the cables leading to the lifting rod 49, thereby acting as a spotter, to avoid injury to the user.

In some embodiments, a ratchet system such as that shown in FIGS. 16-21 may be provided with disc 37, rod 38 and/or cam 39. In these embodiments, if an emergency situation is detected, the ratchet system may be engaged to prevent disc 37, rod 38 and/or cam 39 from rotating backwards, thereby acting as a spotter and preventing any tension from being imparted to bar 49. Referring to the exemplary spotter system embodiment of FIGS. 16-21, it is seen that cam 39 is provided with a plurality of slotted openings 66. A safety latch housing 68 is provided supporting a spring-loaded latch 70. Latch 70 is designed to fit into one of the openings 66 of cam 39. A pin 72 attached to an electronically activatable coil 69 that is engaged with latch 70 to hold it off from insertion into one of openings 66 during normal use. However, should an emergency situation be detected, coil 69 may be activated in order to pull pin 72 from latch 70, causing springs 71 to urge latch 70 forward for engagement into the nearest opening 66, thereby preventing rotation of cam 39, and preventing tension from being transmitted to bar 49 through cable 42. It is to be appreciated other embodiments of spotter devices may be used including without limitation, devices to arrest movement of the cables, devices to disconnect or detach (release) one or more cables, etc. For example, and without limitation, instead of being provided in conjunction with the cam 39, the ratchet system (including the latch and openings described above) can be used in conjunction with the disc 37, rod 38, or some other device rotatable around rod 38. In other examples, the safety system can include a separate device engaged with the rod 38, such as a mechanical or electromechanical brake.

Figure 16:
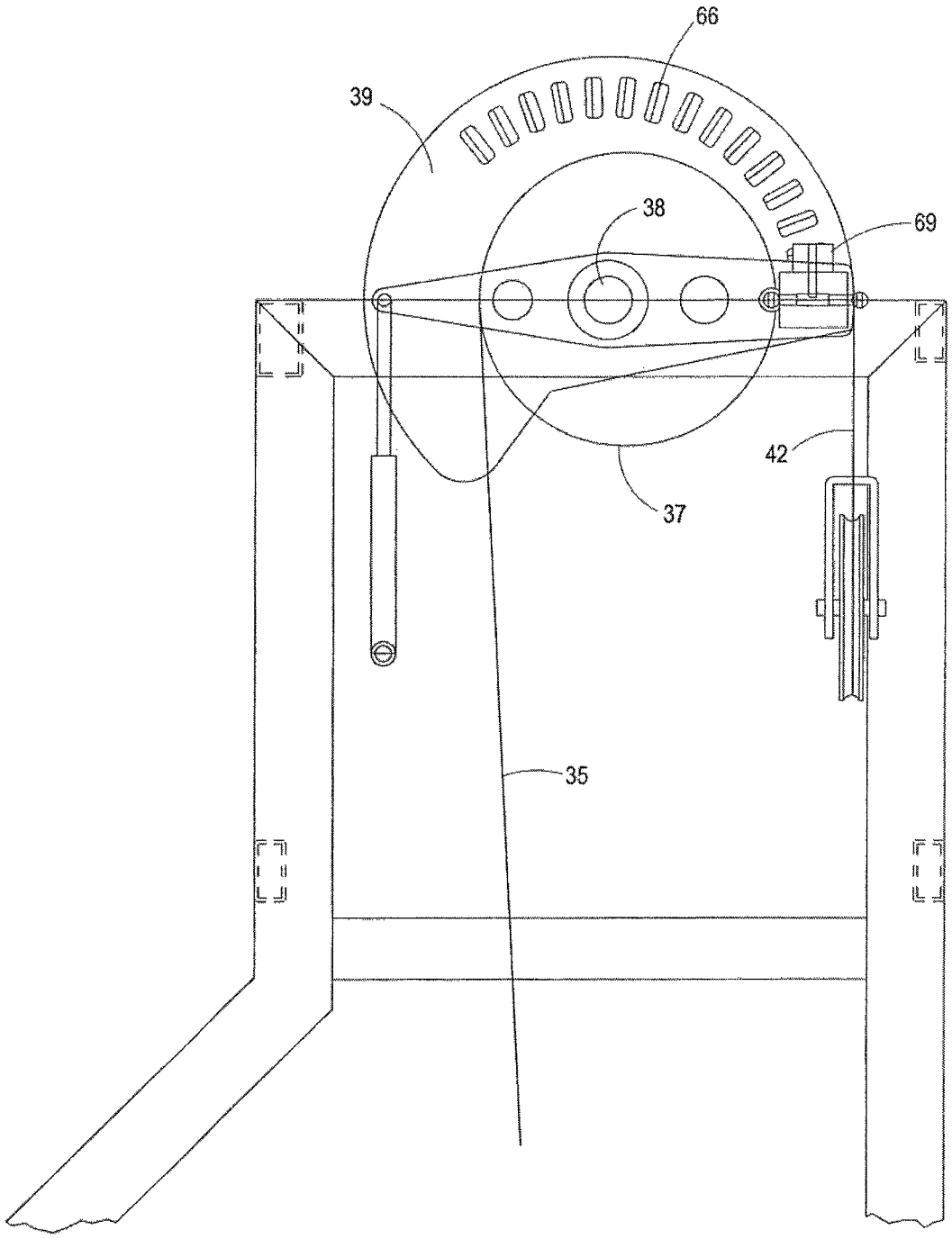
FIG. 16 is a partially cut-away sectional side view of an embodiment of the invention incorporating an emergency tension interruption apparatus.
Figure 19:
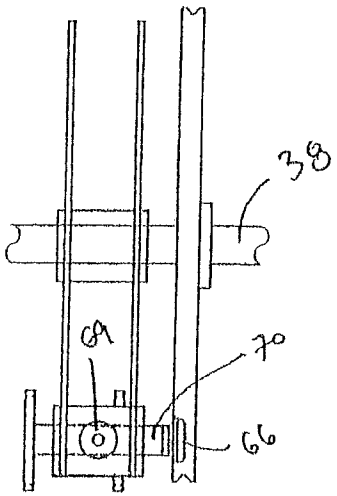
FIG. 19 is a top view of a part of the emergency tension interruption apparatus of FIG. 16.
Figure 18:
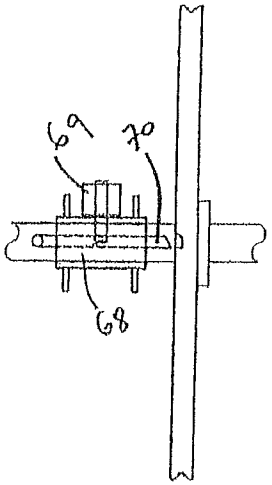
FIG. 18 is an end view of a part of the emergency tension interruption apparatus of FIG. 16.
Figure 21:
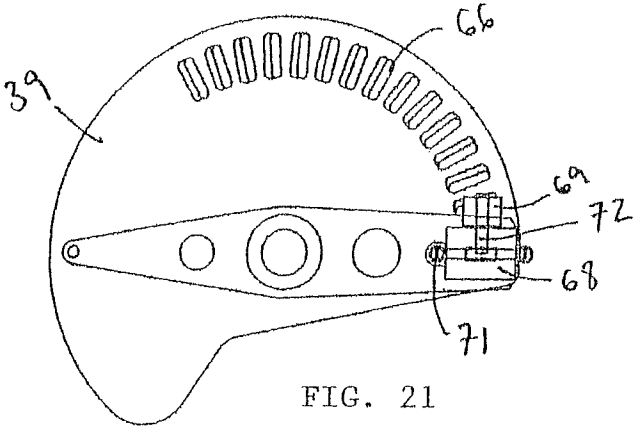
FIG. 21 is a side view of a part of the emergency tension interruption apparatus of FIG. 16.
Figure 17:
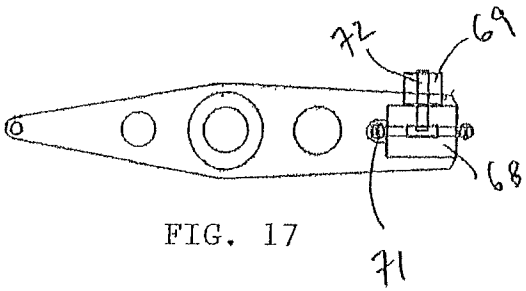
FIG. 17 is a side view of a part of the emergency tension interruption apparatus of FIG. 16.
Figure 20:
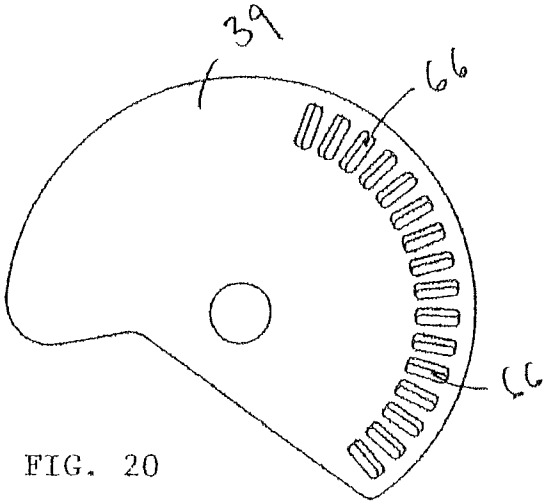
FIG. 20 is a side view of a part of the emergency tension interruption apparatus of FIG. 16.

In some embodiments, one or more additional hold-off or safety cables (not shown) may be attached to the lifting bar 49, and to a safety mechanism similar to that shown in FIG. 16. Should the system detect fatigue in the user, this safety mechanism may be engaged so that the safety cable(s) arrest downward movement of the lifting bar to prevent it from falling or landing on the user.

In most embodiments, upon each start-up, motor 30 preferably moves the weight 24 back to a given home or start position such as 57, and may also perform diagnostics or other internal tests to ensure calibration of the system and encoders. It is expected that the system calibration may be certified by a local city or state weight and measurement department to confirm delivered tension (weight) to bar 49.

Additional programming may be provided in the electronic system to allow the user to designate different amounts of tension/resistance for different repetitions of a set. For example, and without limitation, the user may program the first five repetitions of a set to be at 140 lbs., and the next five to be at 120 lbs. Accordingly, for this example, during use, system 53 will cause weight 24 to be moved after the first five repetitions to a different position on lever 20 in order to change the tension on cables from 140 lbs. to 120 lbs. In other examples, and without limitation, a user may set a total number of repetitions at a given tension or tension reduction per repetition; or the user may establish a second set of repetitions with a lower or higher tension such as: 10 repetitions at 120 pounds tension; or 15 repetitions at 120 pounds tension, then back off or add ½ to 20 pounds per repetition; or a first set of repetitions at one tension, followed by a second set of repetitions at a lower or higher tension. It is to be appreciated that in other examples, and without limitation, the user may program alternating, increasing, decreasing or other variations in tension (weight) for different strokes or repetitions during one or more workouts. In other examples, a predefined weight lifting program can be stored in the system, provided through interface 54 or link 56.

It is to be appreciated that other variations may be employed by the system, including without limitation, weight (tension), stroke and/or time, in order to compensate for real-time variations encountered by a user during a given workout.

For example, and without limitation, a user may select a total number of repetitions and a weight (tension) start point. The system 53 may then reduce or hold a selected amount of weight for every stroke until the repetition count is completed. In this example, the user may enter 150 pounds for the start weight and 10 repetitions. The user also sets the weight to be reduced per stroke from a range of ½ pound steps to 20 pounds per stroke. During such a workout, the tension is changed, for example, by ½ pound each repetition. At the end of the 10 repetitions, the tension is removed, leaving the weight of the bar 49 only.

With respect to stroke, it is to be appreciated that encoder 32 on shaft 38 may be used to keep track of the total stroke distance. As an example, and without limitation, when a first-time or new user enters his/her identification into the system (e.g. swipes a card), the system may require the user to go through a set of repetitions (e.g. 5 of them) at a low tension to learn the users stroke distance and save it in association with the user's ID. This information is gleaned from encoder 32 as the user causes shaft 38 to rotate during each repetition. In some examples, the system may also require the user to hold bar 49 (perhaps at ¾ stroke) as the tension is increased, while at the same time monitoring any movement on shaft 38 to determine the approximate strength abilities of the user. The stroke and/or strength information may then be used later during this user's workouts; for example, during a later workout, as encoder 32 monitors the stroke distances for the user, the system may reduce tension (by moving weight 24 on lever 20) if it detects that the user is not reaching his/her predetermined stroke distance during a set of repetitions. This reduction in tension may enable the user to continue reaching the full stroke distance albeit at a lower tension (weight). The weight reduction information may also be recorded so that the user may review it after the workout to see when and by how much the weight was reduced in order for the user to complete a given workout while maintaining the same stroke distance. This feature may be enabled or disabled at the discretion of the user.

With respect to time, it is to be appreciated that encoder 32 on shaft 38 may be used to keep track of the time it takes for a user to complete each stroke. As an example, and without limitation, an initial time benchmark may be established for a user to complete one stroke and/or an average time may be calculated for a user based on strokes completed during one or more actual workouts. Then, during a later workout, as encoder 32 monitors the stroke time for the user, the system may reduce tension (by moving weight 24 on lever 20) if it detects that the user is taking more time than the benchmark/average stroke time during a set of repetitions. This reduction in tension may enable the user to continue reaching the full stroke within the average/benchmark time albeit at a lower tension (weight). The weight reduction information may also be recorded so that the user may review it after the workout to see when and by how much the weight was reduced in order for the user to complete a given workout while maintaining the same stroke time. This feature may be enabled or disabled at the discretion of the user.

It is to be appreciated that embodiments of the invention may be set to reduce or eliminate the tension to bar 49 if the user holds the bar in a fixed position for a minimal time interval (timeout) following the start of movement in a repetition—indicating fatigue (inability to move the bar further). The timeout may be any appropriate pre-set time interval, but should be short enough to avoid injury yet long enough not to interrupt an otherwise normal workout. In other variations, a total time for a series of repetitions may be established by the user and if that time is exceeded, then tension to bar 49 may be released. Recording of any or all of this information may be enabled or disabled at the discretion of the user.

In further embodiments, the weight system may include alternative systems for connecting the lever member to a weight lifting bar and alternative mechanisms for moving a weight along the lever member. In the illustrated exemplary embodiments shown in FIGS. 22-25, the system may include a single weight-bearing cable that is engaged with a cable carriage attached to the lever member. The cable carriage may serve as the connection between the weight lifting bar and the lever member. The single weight-bearing cable may be routed over pulleys and through the cable carriage, which may be attached to a side of the lever member (e.g., a bottom side of the lever member). In such embodiments, a cable carriage (e.g., cable carriage 2301 shown in FIG. 23) may act as mechanism for adjusting slack in the weight-bearing cable to allow the weight lifting bar to be positioned at various heights and/or distances from the weight system. For example, and without limiting the invention, as the cable carriage moves toward a pivot of the lever member, the slack in the weight-bearing cable may be taken up by the carriage, thereby reducing a height at which the weight lifting bar can be positioned.

Figure 22:
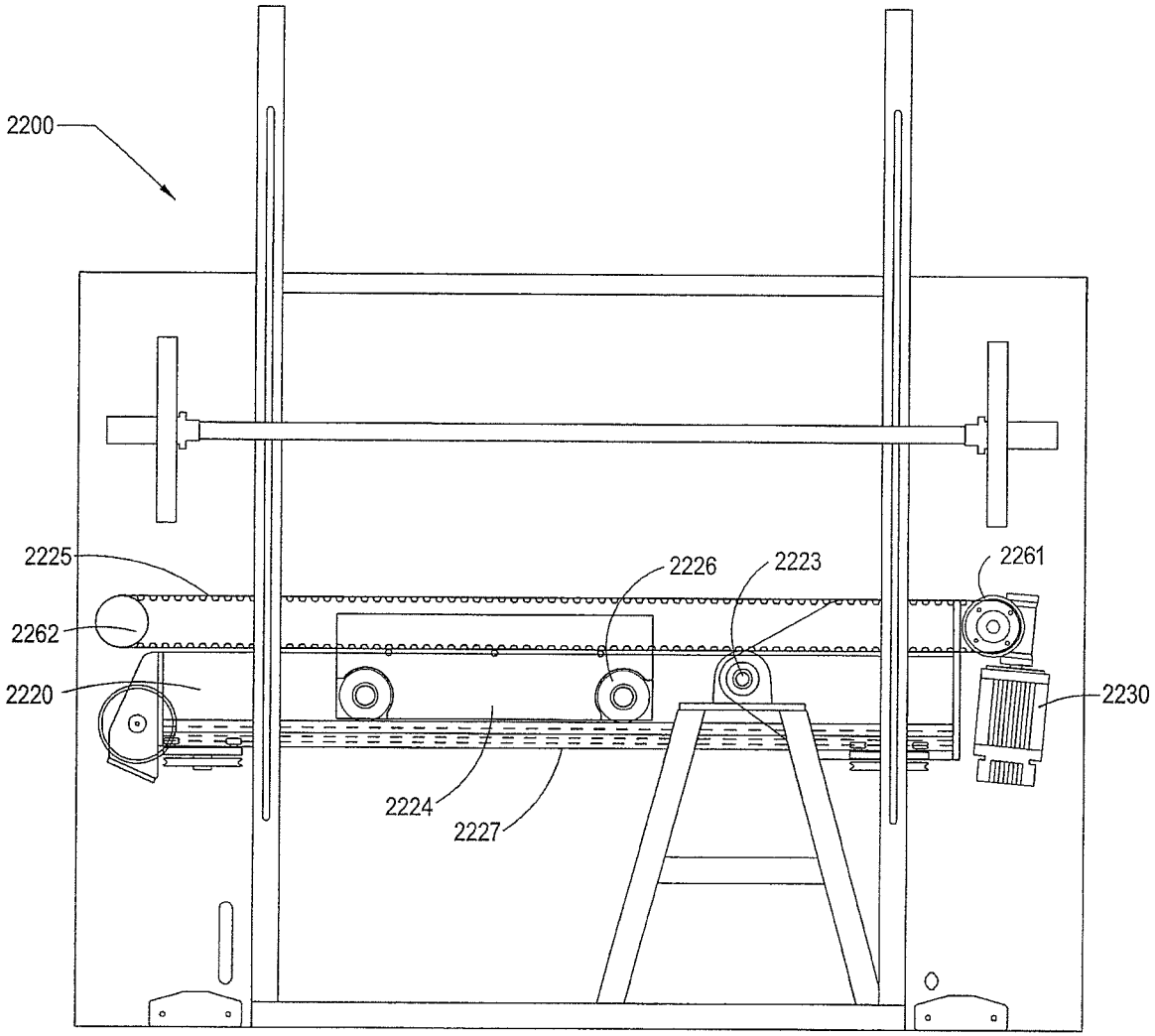
FIG. 22 is a frontal view of an embodiment of the invention. The weight lever system is emphasized in this figure, and some elements of the weight system are not shown.
Figure 25:
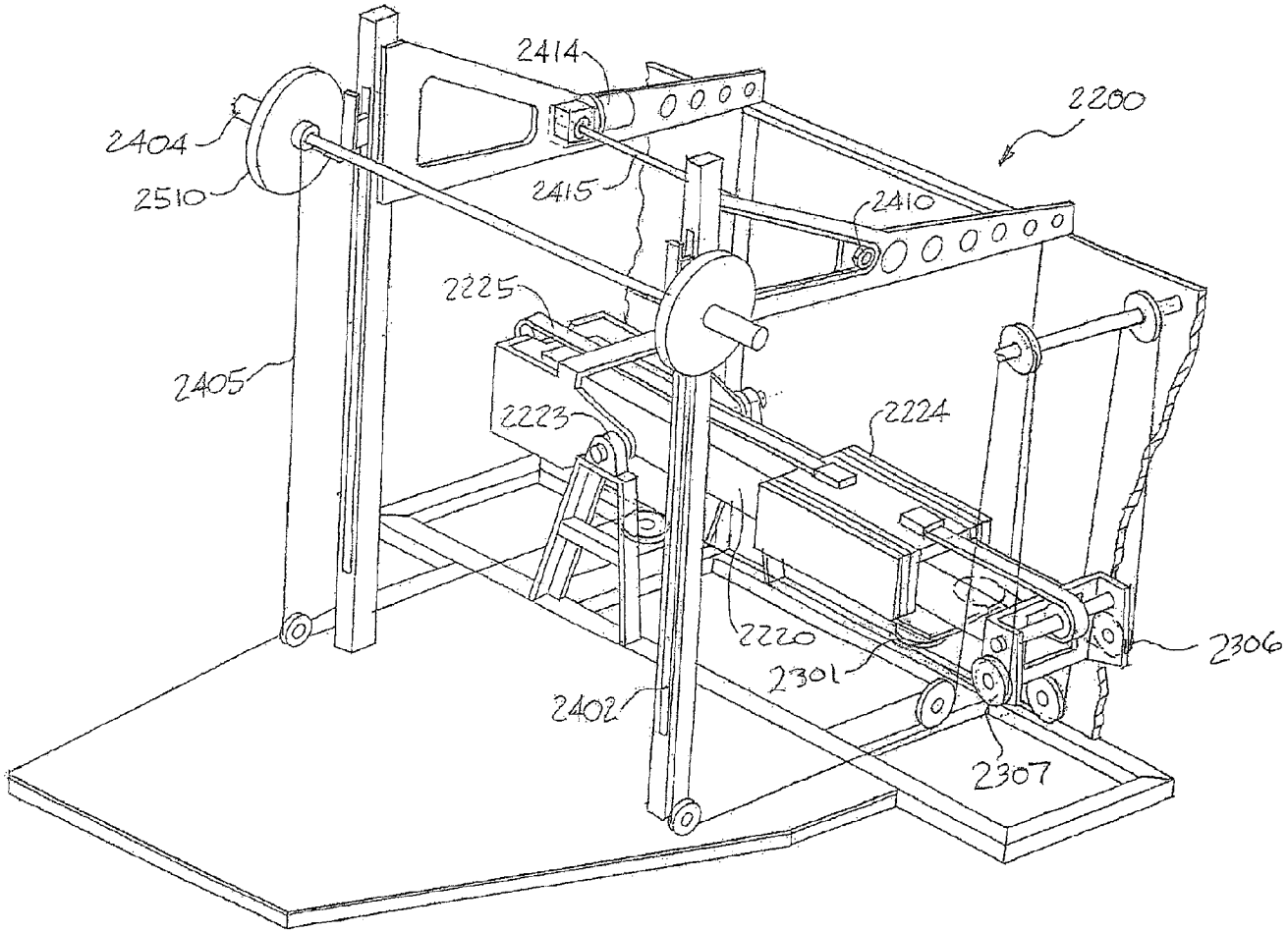
FIG. 25 is a perspective view of an embodiment of the invention.

FIG. 25 provides a perspective view of an exemplary weight system having a leverage mechanism that includes a lever member 2220, cable carriage 2301, a weight carriage 2224, a belt 2225 engaged with said weight carriage, and a pivot mount 2223 on which the lever member is mounted. Each end of a weight lifting bar 2404 may be attached to a single weight-bearing cable 2405, each end of which is routed over a system of pulleys to cable carriage 2301. The cable carriage may be engaged with an underside of the lever member 2220. However, it is to be appreciated that the cable carriage may be alternatively engaged with a top of the lever member 2220, or may be engaged with lever member 2220 at some other suitable location. The connection provided by the cable carriage 2301 to the lever member 2220 allows the lever member 2220 to apply weight to the weight-bearing cable 2405, thereby applying resistance to the movement of the weight lifting bar 2404. As the weight lifting bar 2404 is moved up and down, drawing the weight-bearing cable over the pulleys, an end of the lever member 2220 opposite the pivot 2223 is moved up and down. Although the embodiments illustrated in FIGS. 22 and 25 show the presence of weights 2510 on lifting bar 2404, these are ordinarily not used, since the cable system embodiments of the present invention is capable of providing sufficient resistance (tension/weight) without any such added weights. However, a user may add additional weight in this way, but it will not be subject to the safety mechanisms of the invention discussed below.

In such embodiments, the leverage mechanism may include a belt or chain member that is attached to a weight carriage and moves a weight carriage along the lever member. The weight carriage may be movably engaged with the lever member on a track. For example, the belt or chain member may be attached to an axle system and a motor may be configured to actively spin the axle system in both rotational directions, such that the belt or chain pulls the weight carriage along the lever member. In other examples, the belt or chain member may be attached to a motor that pulls the belt or chain around passive rollers or axles, thereby pulling the weight carriage along the lever member.

As shown in the exemplary embodiment of FIG. 22, a belt or chain 2225 and a motor 2230 may be connected to the weight carriage 2224 for moving the weight carriage along a lever member 2220. The weight carriage may have wheels 2226 that can be engaged with a track 2227 in the lever member 2220. The wheels allow the weight carriage to move easily along the track 2227. It is to be appreciated that wheels 2226 can be substituted with other friction reducing structures, such as bearings. The motor (e.g., a servo motor) 2230 may be attached to and operable to spin an axle that is engaged with belt or chain 2225. The ends of the belt may be attached to the weight carriage and routed around the belt axle and a roller 2262 on an opposite end of the lever member 2220, such that as the belt axle spins, the belt or chain 2225 pulls the weight along a track 2227. The axle may have notches, slots, gear teeth, or other engagement structures for engaging with the belt of chain 2225, which may enable the axle to drive the belt or chain 2225. The belt or chain 2225 may have notches, slots, gear teeth, or other engagement structures that are complementary to the engagement structures of the axle. The motor 2230 may spin the axle in both directions, thereby moving the weight carriage 2224 to and fro along the lever member 2220 via the attached belt or chain 2225. It is to be appreciated that turning belt axle in one direction will cause weight carriage to move towards the motor, and turning the belt axle in the opposite direction will cause weight carriage to move away from the motor. Although movement of carriage 2224 in this illustrated embodiment is accomplished using a belt system 2225, it is to be appreciated that other motion imparting systems may be used including without limitation a rotatable screw, motor, piston, or the like. It is to be further appreciated that other means of moving the weight on the lever member are contemplated in accordance with some embodiments of the present invention.

As explained above, movement of the weight carriage 2224 along the lever member 2220 may adjust the amount of tension or load placed on the weight-bearing cable 2405. The closer that weight carriage 2224 gets to a proximal end of lever member 2220 and the pulleys 2306 and 2307, the more pulling force is required through weight-bearing cable 2405 to lift lever member 2220.

As discussed above, the position and movement of the lever member 2220 may be monitored by an encoder (not shown) attached to or mechanically engaged with the lever member 2220. The encoder may provide data regarding the position and movement of the lever member 2220 to an electronic system (e.g., a computer or processor) capable of monitoring the position of the lever member 2220. Such data may be used by the electronic system to determine the rate at which a user is moving the lifting bar 2404 (e.g., whether the user is becoming fatigued).

Figure 23:
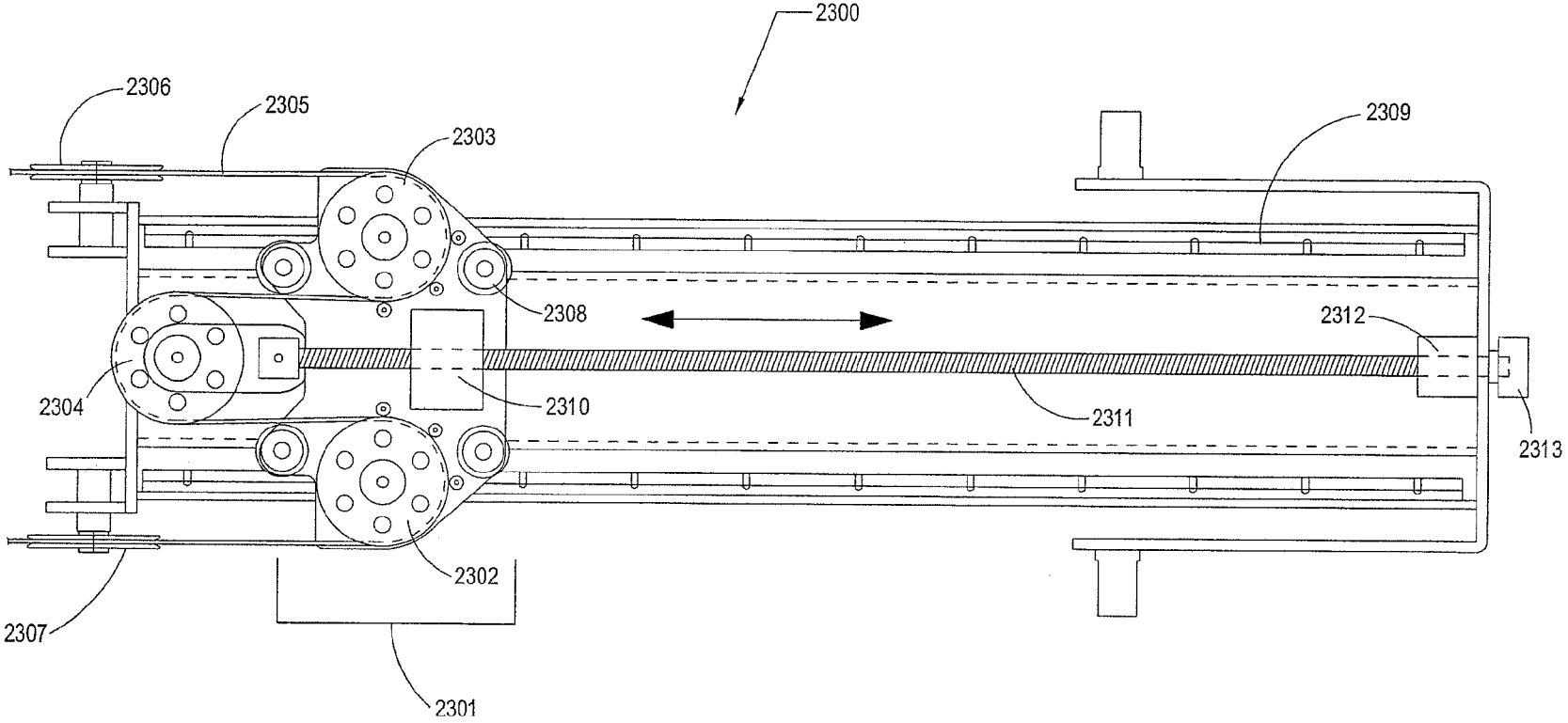
FIG. 23 is a bottom view of an embodiment of the invention. The cable carriage system is emphasized in this figure, and some elements of the weight system are not shown.

As shown in the exemplary embodiment of FIG. 23, a cable carriage system 2300 may include a cable carriage 2301 be mounted on the lever member 2220 (e.g., on the underside of the lever member). The cable carriage may be connected to the lever member 2220 along a track 2309 along which the cable carriage 2301 may move, and by screw member 2311, which may be attached to the lever member 2220 at both ends. The cable carriage 2301 may have wheels 2308 that can be engaged with the track 2309 in the lever member 2220. The wheels allow the cable carriage 2301 to move easily along the track 2309. It is to be appreciated that wheels 2308 can be substituted with other friction reducing structures, such as bearings.

The cable carriage system 2300 may also include a threaded bore member 2310 (e.g., a ball screw nut) attached thereto and engaged with a screw member 2311, as shown in the exemplary embodiment of FIG. 23. In this embodiment, the threaded member 2310 is engaged with the threads of screw member 2311 and is configured to pull the cable carriage 2300 along the screw member 2311 as the screw member turns. A motor 2312 (e.g. a servo motor) is engaged with the screw member 2311, and may be operable to spin the screw in either direction in order draw the threaded member 2310 along the screw member 2311 and thereby move the cable carriage 2301 along the lever member 2220, as indicated by the dual-headed arrow in FIG. 23. It is to be appreciated that rotation of the screw member 2312 in one direction will cause the cable carriage 2301 to move in along the lever member 2220 toward the motor 2312, and rotation in the opposite direction will cause the cable carriage 2301 to move along the lever member 2220 away from the motor.

The movement of the cable carriage 2301 along the lever member 2220 may result in an increase or decrease in slack of weight-bearing cable 2305 (shown as 2405 in FIG. 25). For example, slack in the weight-bearing cable 2305 may be decreased as the cable carriage 2301 moves toward motor 2312 along track 2309. Also, the slack in weight-bearing cable 2305 may be increased as the cable carriage 2301 moves away from motor 2312 along track 2309. The cable carriage is able to adjust the amount of slack in the weight-bearing cable 2305 (shown as 2405 in FIG. 25) because the weight bearing cable may be routed over pulleys 2302 and 2303 of the cable carriage 2301 and a stationary pulley 2304 that may be attached to the lever member 2220. As the cable carriage 2301 moves away from the stationary pulley 2304, the lengths of the sections of cable between the carriage pulleys and stationary pulley 2304 get longer, reducing the amount of slack in said weight bearing cable.

In an exemplary illustration of how the weight-bearing cable may be routed, FIG. 25 shows a weight-bearing cable 2405 that may be routed from one end of the weight lifting bar 2404 over a series of pulleys to the cable carriage 2301. Now referring to FIG. 23, the weight-bearing cable 2305 (shown as 2405 in FIG. 25) may be routed from pulley 2306 to a first carriage pulley 2303, then to stationary pulley 2304, and then around second carriage pulley 2302. The weight-bearing cable 2305 (shown as 2405 in FIG. 25) may then be routed to a second series of pulleys, including pulley 2307, and back to weight lifting bar 2404. The ends of the weight-bearing cable 2405 are each attached directly or indirectly to one end of a lifting bar 2404. It is to be appreciated that the series of pulleys of the weight system may be precisely aligned such that there are no substantial issues with horizontal angularity, vertical angularity, axial offset, or other potential alignment problems that may cause undesired tension or strain issues along the weight-bearing cable that may lead to malfunction or inefficient operation of the weight system.

It is also to be appreciated that as weight lifting bar 2404 is lifted, a pulling force may be transmitted directly through weight-bearing cable 2405 to cable carriage 2301. Resistance to this force may be provided by the weight carriage 2224, which may have various amounts of weight thereon (e.g., about 50 lbs. to about 1000 lbs., or any value or range of values therein). The amount of resistance may be changed by changing the position of weight carriage 2224 along lever member 2220. The position of the weight carriage 2224 on lever member 2220 determines the amount of tension provided through weight-bearing cable 2405, with a maximum load (for example, and without limitation, 450 lbs.) applied when the weight carriage 2224 has been moved to the end of lever 2220. As another example, the position of the weight carriage 2224 may be moved toward the middle of lever member 2220 for a normal load (for example, and without limitation, 200 lbs.). The position of the weight carriage may be adjusted according to the user's preference and performance, as discussed herein.

The cable carriage 2301 and motor 2312 may act together as a safety feature for the weight system 2200. As an example, and without limiting the invention, the motor 2312 engaged with screw member 2311 may be configured such that it can be engaged with the screw member 2311 only when electricity (power) is flowing to the motor. If there is a power failure, a breaker is tripped, the weight system is unplugged, or the motor loses power for any other reason, the motor 2312 disengages from the screw member 2311. As a result, the tension is released from the weight-bearing cable 2405 and the load is released from weight lifting bar 2404. As an illustration and without limitation, when the weight system is in use, there is significant tension on weight-bearing cable 2405, which is exerted on the cable carriage 2301 by the weight-bearing cable. If the motor 2312 releases the screw member to spin freely, the tension on the cable carriage 2301 will be exerted on the screw member 2311 by the threaded member 2310 attached to the cable carriage 2301. As a result, the force exerted by the threaded member 2310 will cause the screw member 2311 to spin rapidly, allowing the cable carriage 2301 to move rapidly toward the stationary pulley 2304, thereby quickly releasing the tension from the weight-bearing cable 2405. This feature of the motor 2312 and screw member 2311 acts as a safety measure for preventing the user from being overburdened with weight in the event that the weight system 2200 loses power. In other embodiments, the event of an emergency detected by the machine (e.g., a weight lifter is in distress indicated by little or no movement in the weight lifting bar), the screw member may be allowed to rotate freely, thereby allowing the cable carriage to rapidly move toward an end of the lever member and creating slack in the weight-bearing cable.

In some embodiments, the weight system may have one or more additional manual safety release switches or levers (e.g., a pedal near the user's feet) that may be attached to the weight lifting bar 2404 or in the user's area of the weight machine. The release switch or lever may be engaged with motor 2312 and/or screw member 2311, and when triggered (e.g. by the foot of a user in an emergency situation) may disengage the motor 2312 from the screw member 2311, allowing the screw member to rotate freely, thereby allowing the cable carriage to rapidly move toward an end of the lever member and creating slack in the weight-bearing cable.

Figure 24:
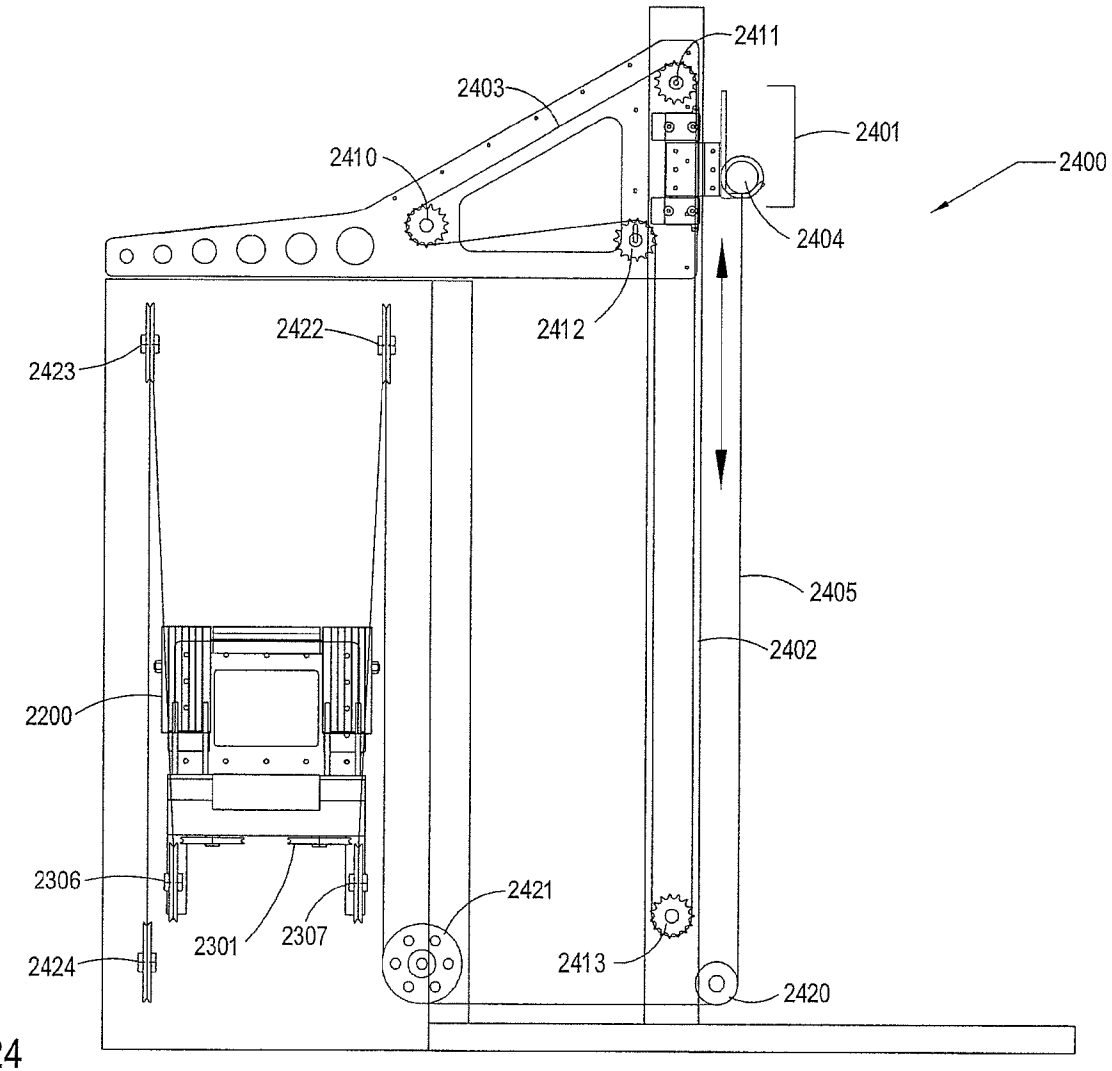
FIG. 24 is a side view of an embodiment of the invention.

Embodiments of the invention may also include a rack system 2200 as shown in FIGS. 24 and 25. The embodiment of FIG. 24 illustrates a side view of an exemplary rack system 2400. Each side of this rack system may include a sprocket or gear 2410 engaged with a sprocket axle (e.g., axle 2415 shown in FIG. 25), a chain or belt 2403 engaged with sprocket or gear 2410 and additional passive sprockets or gears 2411, 2412, and 2413, and a track 2402 in a hollow vertical post along which chain or belt 2403 runs. Each side of the rack system may further include a weight support 2401 that may be engaged with the chain or belt 2403 and the track 2402. The sprocket axle 2415 may be engaged with a motor 2414 (e.g., a servo motor) that can spin the sprocket axle 2415 in both rotational directions, thereby pulling the belt or chain 2403 up and down along the track 2402. The weight support 2401 may be engaged with the chain or belt 2403 and therefore move up and down along the track 2402 with the chain or belt 2403, as indicated by the dual-headed arrow in FIG. 24. Thus, the weight racks 2401 on both sides of the illustrated rack system can be automatically repositioned by motor 2414.

It is to be appreciated that embodiments of the invention illustrated in FIGS. 22-25 may be adapted for use in a wide variety of different weight exercises by changing the starting location of the lifting bar. In accordance with these embodiments, the lifting bar may be placed so that the machine may be used for bench press, squats, cleans, curls, and among other bar lifting exercises.

As discussed above, the weight systems disclosed in the present application may include one or more electronic systems (e.g., a computer using computer numerical control) for controlling the position of a weight on a lever member, the cable carriage, and the weight supports of the weight rack system. A programmable electronic system may be provided to control, among other things, motor 2230 and the position of weight carriage 2224 on lever mechanism 2220 via belt or chain 2225. An encoder may be provided with motor 2230, which is preferably a servo motor. In alternative embodiments, the encoder may be a linear or rotational encoder in communication with the lever member 2220. The encoder may be calibrated in conjunction with motor 2230, belt driving axle 2261, and/or weight carriage 2224 so that system knows the precise position of weight carriage 2224 on lever member 2220, which can be used to determine the amount of weight (tension) provided on weight-bearing cable 2405. The precision of the amount of weight provided depends on the type of encoder used, but in an exemplary embodiment, the encoder may count as many as 10,000 pulses for each rotation of belt driving axle 2261, although other less-precise encoders may be used and still provide satisfactory precision.

In some embodiments, one or more electronic systems may also control a position of the cable carriage 2301 along the lever member 2220 and a vertical position of weight supports 2401. A programmable electronic system may be provided to control motor 2312 and the position of cable carriage 2301 on lever mechanism 2220 via screw member 2311. An encoder 2313 may be provided with motor 2312, which is preferably a servo motor. Encoder 2313 may be calibrated in conjunction with motor 2312, and screw member 2311 so that the electronic system knows the precise position of cable carriage 2301 on lever member 2220 which determines the amount of slack in the weight-bearing cable 2305 (shown as 2405 in FIG. 25). The encoder 2313 may be a relatively precise encoder able to count as many as 10,000 pulses for each rotation of screw member 2311. In alternative embodiments, less-precise encoders may be used and still provide satisfactory precision.

As mentioned above, the one or more electronic systems may also control a vertical position of weight supports 2401. A programmable electronic system may be provided to control motor 2414 and the position of the weight racks 2401 vertical tracks 2402. An encoder (e.g., a rotational encoder) may be provided with motor 2414, which is preferably a servo motor. Alternatively, an encoder (e.g., a linear encoder) may be provided with the vertical track 2402. The encoder may be calibrated in conjunction with motor 2414, a sprocket axle 2415, and/or a rack chain 2403 so that the electronic system knows the precise position of weight racks 2401 on tracks 2402. The electronic systems may also be able to coordinate the positions of the cable carriage 2301 and the weight racks 2401, such that the amount of tension in the weight bearing cable is maintained at or above a predetermined minimum value (e.g., e.g., 1 to 10 lbs., or any value or range of values therein) when the weight lifting bar 2404 is resting on weight supports 2401. The electronic system may have software capable of monitoring the positions of the cable carriage 2301 and the weight racks 2401, and determining the rate of movement and the order of movement of the cable carriage 2301 and the weight supports 2401 required to maintain tension in the weight-bearing cable 2405. The electronic systems may then move the cable carriage 2301 and the weight supports 2401 in a coordinated, simultaneous manner in order to maintain minimum tension in said weight-bearing cable. It is to be appreciated that maintaining a minimum tension in the weight-bearing cable may prevent the weight-bearing cable 2405 from becoming loose as the weight racks 2401 and cable carriage 2301 are repositioned.

The electronic systems may have manual inputs such as buttons, dials, switches, or the like (including without limitation one or more keypads), and/or electronic inputs and outputs such as a magnetic or optical reader, USB or other port, etc. provided on or with a user interface (e.g., a touchscreen, a monitor and keypad, etc.). The user may input his/her identity and other information regarding the desired workout using any of these inputs (keypad, manual ID number input, magnetic ID card, upload from a portable electronic device, etc.). Embodiments of the electronic system maintain information about each user, including height, arm length, workout routines performed by the user, and other information from inputs on by the user in the interface or other data sources. A user's personal data and workout parameters may be used to automatically adjust the position of the weight carriage 2224, the position of the cable carriage 2301, and the position of the weigh supports 2401 so that the weight bar is at the proper height for the particular user.

In an exemplary illustration, if the user's body measurements (e.g., height and arm length) and workout parameters are inputted into the electronic system, the user can simply identify himself and the exercise that he intends to perform using the interface, and the electronic system will adjust the positions of the weight carriage 2224, the cable carriage 2301, and the weight supports 2401 based on the user's data. The positioning of the cable carriage 2301 and the weight supports 2401 may be coordinated by the electronic system so that there is no excess slack in weight-bearing cable 2405. The weight carriage 2224 may remain in a "home position" near or over a pivot 2223 (in home position, the weight carriage 2224 may exert little or no downward force on the weight bearing cable) until the user has removed the weight lifting bar 2404 from the weight racks 2401. An encoder engaged with the lever member 2220 may sense when the bar is moved off of the weight supports 2401, and alert the electronic system that the user is ready to perform an exercise. The electronic system may then move the weight carriage 2224 to a predetermined position on the lever member 2220 according to the user's personalized data.

The user data stored by the electronic systems may also include such things as, without limitation, the weight(s) (tension) to be applied during a particular workout; number of repetitions for the workout; desired time interval(s) between repetitions and/or a time to complete the entire workout; any scheduled changes to be made to the tension during the workout (e.g. increasing, decreasing and/or alternating tension for different repetitions in the workout); ranges of acceptable deviations from any of tension (e.g., adding or removing a selected amount of weight based on the speed of movement imparted to the lever member by the user), repetitions, time interval(s), etc.; and/or whether or not to record feedback from the workout. It is to be appreciated that different combinations of these selections may be made by the user to more particularly tailor a given workout or exercise regimen. This information can be used to adjust the position of the weight carriage 2224 on the lever member 2220 during the exercise. For example, if the movement of the lever member 2220 slows to a certain predetermined speed (e.g., the user is struggling to lift the weight lifting bar 2404), an encoder associated with the lever member 2220 may signal the electronic control system, which can then activate the motor 2230 to move the weight carriage 2224 toward the pivot 2223 to reduce the tension on weight-bearing cable 2405 and allow the user to finish an exercise. Or, if the movement of the lever member has completely stopped or the lever begins moving downward before a lift repetition has been completed (e.g., the user has fatigued and may be collapsing), the electronic systems can signal the motor 2230 to rapidly move the weight to the "home position" over the pivot, removing the load from weight lifting bar 2404.

The electronic system may be able to selectively vary the amount of tension added or subtracted to weight bearing cable (by moving the weight carriage 2224) during the user's repetitions based on the user's data and the information received by the electronic system from the encoder associated with the lever system. More specifically, if the user is moving the lifting bar 2404 at a usual or expected rate (e.g., the user's fatigue is normal during a particular set of repetitions in comparison to the user's past workout data), the electronic system may reduce the amount of tension on the weight-bearing cable in a preset increment selected by the user via the interface. However, if the user is fatiguing quickly and/or the user's lifting rate is substantially less than the usual or expected rate based on the user's data, the electronic system may select a different amount of tension to be removed from the weight-bearing cable (e.g., 2 or more pounds versus the user's selected incremental reduction of 1 pound). Thus, the electronic system may be adaptive and assist the user to complete a set of repetitions without excessive strain and at a relatively consistent rate of lifting repetitions. It is to be appreciated that electronic system may also selectively add tension to the weight-bearing cable, if the user's repetition rate is higher than expected. It is also to be appreciated that the adjustments in the tension on the weight-bearing cable may be performed as the user is in the process of lifting the lifting bar (e.g., during a set of repetitions), thereby adjusting the weight experienced by the user while he is exercising. However, the electronic system may also adjust the amount of tension on the weight-bearing cable between lifting sets based on a user's preset workout routine. The combination of the electronic system, the motor 2230, and the encoder are capable of rapidly responding to changes in user's energy or fatigue lever, and may be able to add or remove several pounds per second (e.g., up to 70 pounds per second).

Some embodiments of the invention include a port or networking link that allows data stored in the electronic system of the present invention to be accessed and/or downloaded, directly or indirectly, from or onto another device, such as a PDA, iPod, local storage, removable storage, network storage, network computer, or the like. This makes the data available for the user to incorporate into other databases, programs or devices for archival, study, entertainment, competition or other purposes.

It is to be understood that variations, modifications and combinations of the elements of the various embodiments of the present invention may be made without departing from the scope thereof. It is also to be understood that the present invention is not to be limited by the specific embodiments disclosed herein, but only in accordance with the appended claims when read in light of the foregoing specification.

What is claimed is:

1. A cable tension system comprising:

a) a pivotally mounted lever mechanism;

b) a weight movably engaged with said lever mechanism;

c) a first motion imparting mechanism for moving said weight with respect to said lever mechanism;

d) a cable attached to a lifting bar;

e) a cable carriage moveably engaged with said lever mechanism, wherein said cable is routed around a first routing point on said lever mechanism and a second routing point on said cable carriage; and f) a second motion imparting mechanism for moving said cable carriage with respect to said first routing point on said lever mechanism, wherein moving said cable carriage with respect to said first routing point adjusts a length of said cable between said lever mechanism and said lifting bar wherein said lever mechanism comprises a first track, and said weight comprises a plurality of rotatable wheels for traveling on said first track, said lever mechanism comprises a second track, and said cable carriage comprises wheels engaged with said second track.

2. The tension system of claim 1, further comprising a rack system comprising:

a) a frame having a first vertical post and a second vertical post;

b) a first track in said first vertical post and a second track in said second vertical post;

c) a first belt or chain running along said first track in said first vertical post, and a second belt or chain running along said second track in said second vertical post; and d) a first weight support engaged with said first belt or chain and moveably engaged with said first track in said first vertical post, and a second weight support engaged with said second belt or chain and moveably engaged with said second track in said second vertical post.

3. The tension system of claim 2, further comprising a processor in electronic communication with said first motion imparting mechanism, a first encoder in electronic communication with said processor for determining a position of said weight relative to said lever mechanism, a second encoder in electronic communication with said processor for determining an angular position of said lever mechanism, and a user interface in communication with said processor.

4. The tension system of claim 3, further comprising said processor in electronic communication with said second motion imparting mechanism, a third encoder in electronic communication with said processor for determining a position of said cable carriage relative to said lever mechanism, a fourth encoder in electronic communication with said processor for determining vertical positions of said first and second weight supports.

5. The tension system of claim 4, further comprising computer executable instructions adapted to cause said processor to change said position of said cable carriage and said vertical positions of said first and second weight supports.

6. The tension system of claim 5, further comprising a data port in communication with said processor for receiving or transmitting user data, wherein said user data comprises at least one member selected from the group consisting of a user identifier, user body measurements, and workout parameters, and said computer executable instructions adapted to cause said processor to change said position of said cable carriage and said vertical positions of said first and second weight supports in response to said user data.

7. The tension system of claim 3, further comprising a data port in communication with said processor for receiving or transmitting user data, wherein said user data comprises at least one member selected from the group consisting of a user identifier, workout parameters, and combinations thereof.

8. The tension system of claim 7, further comprising computer executable instructions adapted to cause said processor to detect and measure movement of said lever mechanism and to change the position of said weight relative to said lever mechanism in response thereto.

9. The tension system of claim 7, further comprising computer executable instructions adapted to cause said processor to detect and measure movement of said lever mechanism and to change the position of said weight relative to said lever mechanism in response thereto, wherein said processor changes the position of said weight while said user is moving the lifting bar.

10. The tension system of claim 2, wherein said rack system further comprises at least one first sprocket or gear engaged with said first belt or chain, and at least one second sprocket or gear engaged with said second belt or chain.

11. The tension system of claim 10, wherein said rack system further comprises a sprocket axle engaged with said at least one first sprocket or gear and said at least one second sprocket or gear.

12. The tension system of claim 11, wherein said rack system further comprises a weight rack motor engaged with said sprocket axle and operable to rotate said axle in both rotational directions.

13. The tension system of claim 12, further comprising an encoder in mechanical communication with said sprocket axle for determining a vertical position of said first weight support relative to said first track in said first vertical post, and a vertical position of said second weight support relative to said second track in said second vertical post.

14. The tension system of claim 13, further comprising a processor in electronic communication with said weight rack motor and said encoder, said processor operable to monitor and adjust the vertical positions of said first and second weight supports.

15. The tension system of claim 1, further comprising a processor in electronic communication with said first motion imparting mechanism and operable to monitor a position and a speed of said lever mechanism and adjust a position of said weight while a user is using said system.

16. The tension system of claim 15, wherein said processor is in electronic communication with said second motion imparting mechanism and is operable to monitor a position of said cable carriage and adjust a position of said cable carriage.

17. The tension system of claim 15, further comprising an encoder operable to monitor the position of said lever mechanism and the speed at which said lever mechanism moves, said encoder is in electrical communication with said processor.

18. The tension system of claim 15, further comprising an encoder in electronic communication with said processor and in mechanical communication with said first motion imparting mechanism for determining the position of said weight relative to said lever mechanism.

19. The tension system of claim 1, wherein said first motion imparting mechanism for moving said weight comprises a belt or chain and a motor, said belt or chain and motor mechanically coupled to said weight and operable to move said weight along said first track in said lever mechanism.

20. The tension system of claim 19, wherein a magnitude of tension on said cable corresponds to a position of said weight with respect to said lever mechanism.

21. The tension system of claim 1, wherein said second motion imparting mechanism for moving said cable carriage comprises a motor and a rotatable threaded screw in operative communication with said cable carriage.

22. The tension system of claim 21, wherein said motor of said second motion imparting mechanism is operable to disengage said rotatable threaded screw if no power is supplied to the motor.

23. The tension system of claim 1, further comprising a processor in electronic communication with said second motion imparting mechanism and operable to monitor a position of said cable carriage with respect to said lever mechanism and activate said second motion imparting mechanism to move and adjust the position of said cable carriage with respect to said lever mechanism.

24. The tension system of claim 23, further comprising an encoder in electronic communication with said processor and in mechanical communication with said second motion imparting mechanism for determining the position of said cable carriage relative to said lever mechanism.

25. The tension system of claim 1, wherein said second routing point on said cable carriage comprises a first pulley and a second pulley, said first routing point on said lever mechanism comprises a stationary pulley, and said cable is sequentially routed over said first pulley, said stationary pulley, and said second pulley.

26. The tension system of claim 25, wherein said cable carriage is operable to adjust slack in said cable by moving along said second track in said lever mechanism.

27. The tension system of claim 1, wherein said cable carriage is operable to reduce slack in said cable and to limit a distance that said lifting bar can be moved.

28. A method of adjusting a height of a lifting bar in a weight lifting apparatus comprising the steps of:

coupling opposite ends of said lifting bar to a cable;

routing said cable around a stationary pulley and through a cable carriage moveably installed on a track of a pivoting weight lever mechanism, wherein said cable carriage comprises a first pulley and a second pulley, said stationary pulley is on said weight lever mechanism, and said cable is sequentially routed over said first pulley, said stationary pulley, and said second pulley; and moving said cable carriage along said track relative to said stationary pulley to adjust slack in said cable, wherein moving said cable carriage comprises rotating a rotatable threaded screw operatively engaged with said cable carriage through a threaded bore in said cable carriage, wherein rotating said screw in a first rotational direction moves the cable carriage toward a pivot point of said pivoting weight lever mechanism and rotating said screw in a second rotational direction moves the cable carriage away from said pivot point, wherein moving said cable carriage away from said pivot point decreases a distance between i) said first and second pulleys and ii) said stationary pulley, shortens a section of said cable located between i) said first and second pulleys and ii) said stationary pulley, and increases slack in said cable.

29. The method of claim 28, further comprising adjusting a height of at least one weight support on which said lifting bar rests.

30. The method of claim 29, wherein moving said cable carriage and adjusting the height of said at least one weight support are controlled by a processor in electronic communication with a first motion imparting mechanism engaged with said cable carriage and a second motion imparting mechanism engaged with said at least one weight support.

31. The method of claim 30, wherein said processor instructs said first and second motion imparting mechanisms to move said cable carriage and said at least one weight support to new positions based on user data, wherein said user data comprises at least one member selected from the group consisting of a user identifier, user body measurements, and workout parameters.

32. The method of claim 31, wherein moving said cable carriage and adjusting the height of said at least one weight support are performed simultaneously.

33. The method of claim 29, wherein moving said cable carriage and adjusting the height of said at least one weight support are performed simultaneously.

34. The method of claim 33, wherein said weight lifting apparatus comprises a processor in electronic communication with a first motion imparting mechanism for moving said cable carriage and a second motion imparting mechanism for adjusting said height of said at least one weight support, and wherein said processor comprises computer executable instructions for coordinating the positions of said cable carriage and said at least one weight support such that a predetermined minimum tension is maintained in said cable during said simultaneous movement of said cable carriage and said adjustment of the height of said at least one weight support.

35. The method of claim 28, wherein moving said cable carriage toward from said pivot point increases the distance between i) said first and second pulleys and ii) said stationary pulley, lengthens the section of said cable located between i) said first and second pulleys and ii) said stationary pulley, and reduces slack in said cable.

36. The method of claim 28, further comprising the steps of: providing a movable weight on said pivoting weight lever mechanism, and moving said weight with respect to said lever mechanism to change tension on said cable.

37. A cable tension system comprising:

a) a pivotally mounted lever mechanism;

b) a weight movably engaged with said lever mechanism;

c) a first motion imparting mechanism for moving said weight with respect to said lever mechanism;

d) a cable attached to a lifting bar;

e) a cable carriage moveably engaged with said lever mechanism, wherein said cable is routed around a first routing point on said lever mechanism and a second routing point on said cable carriage;

f) a second motion imparting mechanism for moving said cable carriage with respect to said first routing point on said lever mechanism, wherein moving said cable carriage with respect to said first routing point adjusts a length of said cable between said lever mechanism and said lifting bar;

g) a rack system including:

i) a frame having a first vertical post and a second vertical post, ii) a first track in said first vertical post and a second track in said second vertical post, iii) a first belt or chain running along said first track, and a second belt or chain running along said second track, and iv) a first weight support engaged with said first belt or chain and moveably engaged with said first track in said first vertical post, and a second weight support engaged with said second belt or chain and moveably engaged with said second track in said second vertical post;

h) a processor in electronic communication with said second motion imparting mechanism, a first encoder in electronic communication with said processor for determining a position of said cable carriage relative to said lever mechanism, a second encoder in electronic communication with said processor for determining vertical positions of said first and second weight supports on said first and second vertical posts, and a user interface in communication with said processor; and i) computer executable instructions adapted to cause said processor to change said position of said cable carriage relative to said lever mechanism and said vertical positions of said first and second weight supports on said first and second vertical posts.

38. The tension system of claim 37, wherein said rack system further comprises at least one first sprocket or gear engaged with said first belt or chain, and at least one second sprocket or gear engaged with said second belt or chain.

39. The tension system of claim 38, wherein said rack system further comprises a sprocket axle engaged with said at least one first sprocket or gear and said at least one second sprocket or gear.

40. The tension system of claim 39, wherein said rack system further comprises a weight rack motor engaged with said sprocket axle and operable to rotate said axle in both rotational directions.

41. The tension system of claim 40, wherein said second encoder is in mechanical communication with said sprocket axle for determining a vertical position of said first weight support relative to said first track in said first vertical post, and a vertical position of said second weight support relative to said second track in said second vertical post.

42. The tension system of claim 40, wherein said processor is in electronic communication with said weight rack motor.

43. The tension system of claim 37, wherein said processor is in electronic communication with said first motion imparting mechanism and operable to monitor a position and a speed of said lever mechanism and adjust a position of said weight while a user is using said tension system.

44. The tension system of claim 43, further comprising a third encoder configured to monitor the position of said lever mechanism and the speed at which said lever mechanism moves, said third encoder in electrical communication with said processor.

45. The tension system of claim 43, further comprising a fourth encoder in electronic communication with said processor and in mechanical communication with said first motion imparting mechanism for determining the position of said weight relative to said lever mechanism.

46. The tension system of claim 37, wherein said processor is in electronic communication with said first motion imparting mechanism, a third encoder in electronic communication with said processor for determining a position of said weight relative to said lever mechanism, a fourth encoder in electronic communication with said processor for determining an angular position of said lever mechanism.

47. The tension system of claim 46, wherein said computer executable instructions are adapted to cause said processor to detect and measure movement of said lever mechanism and to change the position of said weight relative to said lever mechanism in response to said movement of said lever mechanism.

48. The tension system of claim 46, wherein said computer executable instructions are adapted to cause said processor to detect and measure movement of said lever mechanism and to change the position of said weight relative to said lever mechanism in response to said movement of said lever mechanism, wherein said processor changed the position of said weight while said user is moving the lifting bar.

49. The tension system of claim 37, wherein said cable carriage is operable to reduce slack in said cable and to limit a distance that said lifting bar can be moved.

50. The tension system of claim 49, wherein the magnitude of a tension on said cable corresponds to the position of said weight with respect to said lever mechanism.

51. The tension system of claim 37, wherein said lever mechanism comprises a first track, and said weight comprises a plurality of rotatable wheels for traveling on said first track.

52. The tension system of claim 51, wherein said lever mechanism comprises a second track, and said cable carriage comprises wheels engaged with said second track.

53. The tension system of claim 37, wherein said second routing point on said cable carriage comprises a first pulley and a second pulley, said first routing point on said lever mechanism comprises a stationary pulley, and said cable is sequentially routed over said first pulley, said stationary pulley, and said second pulley.

54. The tension system of claim 53, wherein said cable carriage is operable to adjust slack in said cable by moving along a track in said lever mechanism.

55. The tension system of claim 37, further comprising a data port in communication with said processor for receiving or transmitting user data, wherein said user data comprises at least one member selected from the group consisting of a user identifier, user body measurements, and workout parameters, wherein said processor analyzes said user data using said computer executable instructions and changes said position of said cable carriage and said vertical positions of said first and second weight supports based on said user data.

56. The tension system of claim 37, wherein said first motion imparting mechanism for moving said weight comprises a belt or chain and a motor, said belt or chain and motor mechanically coupled to said weight and operable to move said weight along a track in said lever mechanism.

57. The tension system of claim 37, wherein said second motion imparting mechanism for moving said cable carriage comprises a motor and a rotatable threaded screw in operative communication with said cable carriage.

* * * * *